United States Patent [19]

Haspert

[11] 4,062,594

[45] Dec. 13, 1977

[54] RECIPROCATING DRIVE METHOD OF MINING AND APPARATUS THEREFOR

[76] Inventor: John C. Haspert, 895 Coronado Drive, Arcadia, Calif. 91006

[21] Appl. No.: 697,320

[22] Filed: June 18, 1976

[51] Int. Cl.[2] ..... E21C 25/06

[52] U.S. Cl. ..... 299/10; 175/336; 299/38; 299/40; 299/86; 299/89

[58] Field of Search ..... 299/36, 38, 40, 10, 299/15, 85, 23, 86, 20, 89; 175/336, 350; 225/95, 96; 125/23

[56] References Cited

U.S. PATENT DOCUMENTS

| | | | |
|---|---|---|---|
| 1,353,908 | 9/1920 | Hodgson | 299/86 |
| 2,057,684 | 10/1936 | Joy | 299/10 |
| 2,283,212 | 5/1942 | Joy | 299/23 |
| 3,139,148 | 6/1964 | Robbins | 299/86 |
| 3,612,030 | 10/1971 | Blum | 299/86 |
| 3,695,724 | 10/1972 | Taylor | 299/85 |
| 3,776,594 | 12/1973 | Haspert | 299/18 |

*Primary Examiner*—Ernest R. Purser
*Assistant Examiner*—William F. Pate, III
*Attorney, Agent, or Firm*—Gene W. Arant

[57] ABSTRACT

A method of mining utilizing a reciprocating drive, in which a tooth is driven along a relatively straight path over an ore surface in one direction of movement so as to cut a groove therein, and then a wheel is substituted in place of the tooth and is rolled within the groove in the opposite direction, the wheel having a radially wedge-shaped circumferential edge portion which applies laterally outward and downward crumbling forces to the groove walls.

Both the tooth and the wheel may be incorporated into a unitary wheel assembly as a single tool, by attaching the tooth to a point on the circumference of the wheel. The tool is then locked against rotation during its powered drive stroke in one direction, when the tooth engages the groove, but during its stroke in the other direction is released to permit rotation of the wheel.

The method provides for working a number of parallel grooves concurrently, with wheels being utilized only in alternate ones of the grooves.

The method may be applied to the end face of a horizontal tunnel, the end face being sloped and the mining tools reciprocating up and down the slope.

24 Claims, 27 Drawing Figures

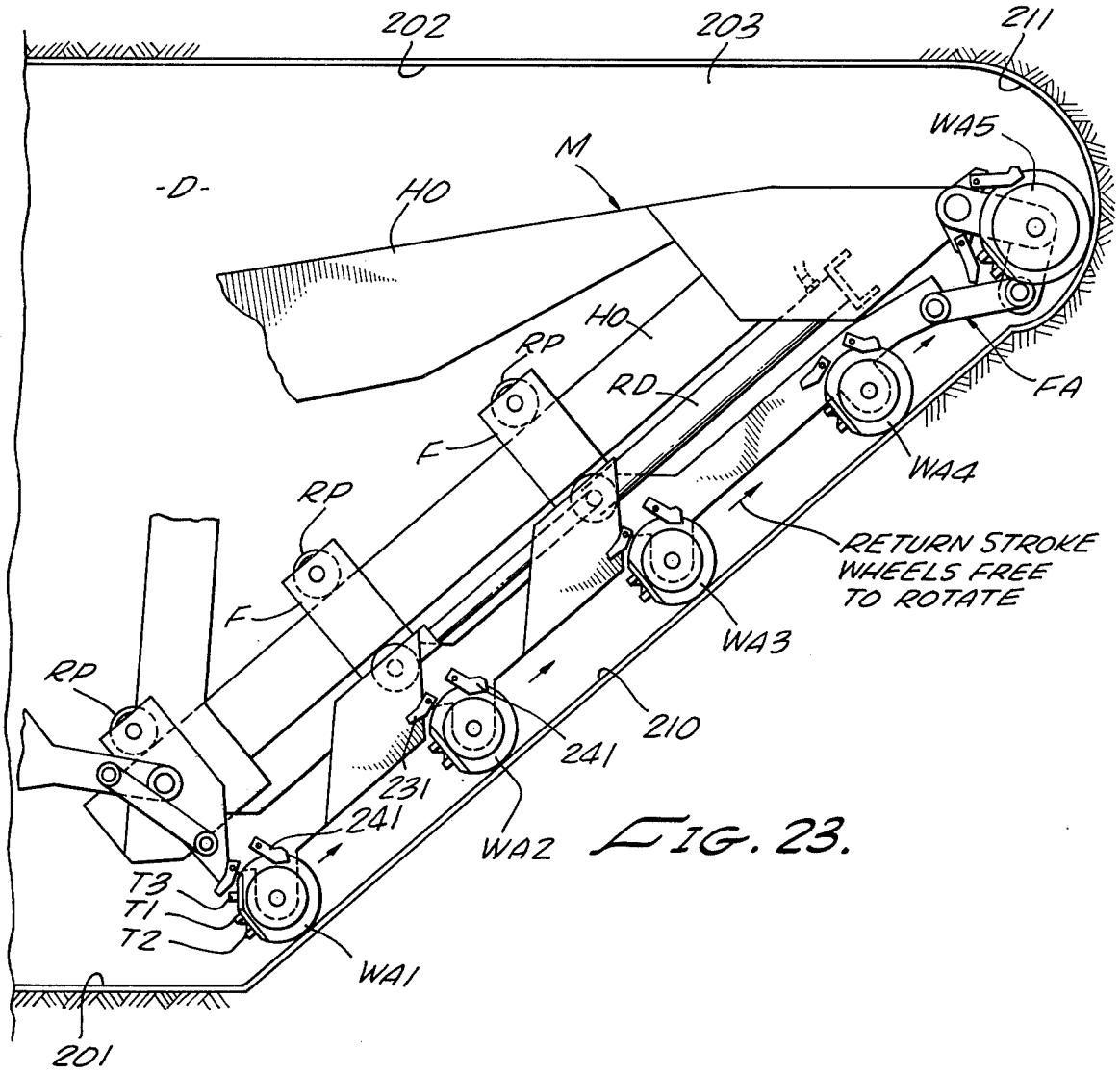
FIG. 23.
FIG. 24a.
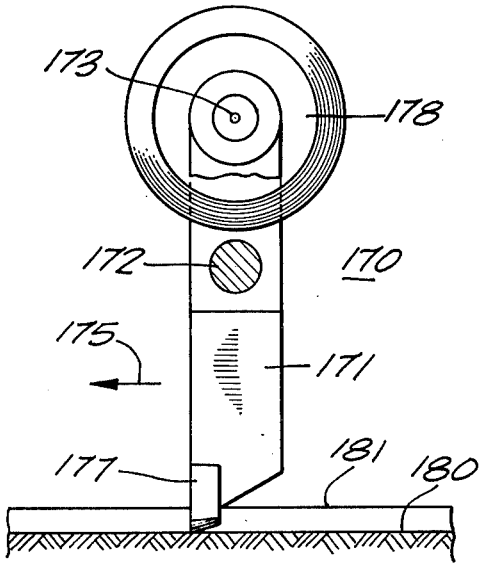
FIG. 24b.
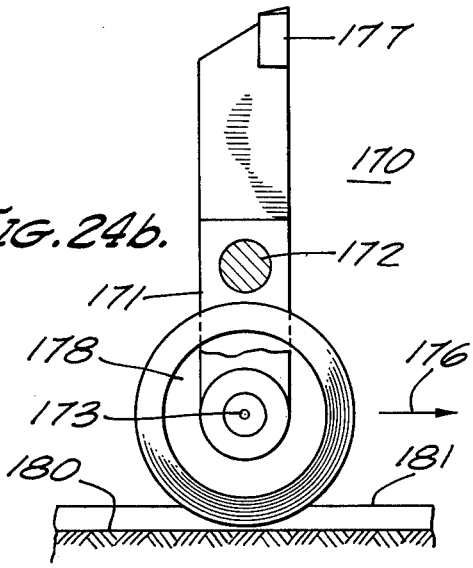

RECIPROCATING DRIVE METHOD OF MINING AND APPARATUS THEREFOR

BACKGROUND OF THE INVENTION

The present invention relates to a new and improved method for underground mining, which is particularly applicable to the mining of material such as oil shale or coal, or other ore materials having about the strength of medium-strength rock.

A known method of mining coal is to utilize a machine equipped with a number of toothed wheels which are continuously rotated by a power drive, and to apply the rotating toothed edges of the wheels to the ore surface so as to progressively grind or chew away the ore material. This type of machine may be guided along a substantially horizontal path to form a drift or tunnel as the mining action progresses.

In the prior art it has also been known to apply a rotary cutting action to the end face of a bore or tunnel. Machines including a combination of cutting teeth and wedge-shaped wheels have been used for this purpose, both in mining operations and in tunnel construction.

The previously known mining techniques which have been applied in the underground mining of medium-strength materials have been subject to several disadvantages or limitations. One very serious disadvantage is that the cutting load has been unevenly distributed among the various cutting elements of the machine, causing some of the cutting elements to wear more rapidly than others. This problem has, in turn, necessitated frequent shut-downs of the machinery for the purpose of repairing or replacing the worn cutting elements.

Another serious disadvantage of the prior art methods has been that the mining action produces ore particles having highly irregular shapes and widely varying sizes. Where the ore material is refined, the non-uniformity of the particle size has added a great deal to the complexity and cost of the refining process.

Thus the principal object and purpose of the invention is to provide a method for totally mechanized underground mining, which will produce ore particles having a high degree of uniformity as to size, and which will also maximize the time between shut-downs of the machinery.

Another principal object of the invention is to provide a mining method which will remove a higher percentage of available material from the mine than has been possible with prior methods.

SUMMARY OF THE INVENTION

In its general form the present invention involves the use of a mining tool structure including both a cutting tooth and a wheel having a wedge-shaped circumferential edge portion, the tooth and the wheel being alternately applied to an ore surface from which ore material is to be dislodged. A reciprocating drive action is applied to the tooth structure along a relatively straight path in a direction parallel to the ore surface being mined. In one direction of movement (the forward direction) the weight of the tool structure, including at least the tooth and the wheel, is applied only to the tooth so that the tooth will cut a groove in the ore surface. In the other (rearward) direction of movement the wheel is substituted for the tooth, the weight of the tool structure is then applied to the wheel, and the wheel is rolled along the ore surface with its circumferential edge portion extending into the groove. The wheel because of the wedge shape of its edge then applies a laterally outward and downward crumbling force to the groove walls.

More specifically, at least three parallel grooves are cut in the ore surface, and the wheel is then rolled down the central one of the three grooves with the immediately adjacent portions of the other two grooves being not occupied by any mining tool, so that the other two grooves provide relief for ore material that may be dislodged in a lateral direction by the wedging action of the wheel. Since all of the grooves are cut on substantially straight lines, the lateral dislodgment of material is not inhibited by compressive forces extending within the ore material in a direction parallel to the groove within which the wheel rolls. As a result, the dislodged ore particles are of substantially uniform size and shape.

In the presently preferred form of the invention the cutting tooth and the wheel are combined in a single tool. This is accomplished by rigidly attaching the tooth to the wheel at a point on the circumference of the wheel, so that the tooth extends radially with respect to the wheel and at least as far as the wheel edge. With this type of tool structure, then, during the drive stroke in the forward direction the tooth is placed in engagement with the ore surface and the wheel is held against rotation, while during the drive stroke in the rearward direction the wheel is permitted to rotate with the result that after an initial amount of rotation occurs the tooth is automatically lifted from the groove and the wedge-shaped wheel edge portion is substituted therein in its place.

The mining method of the present invention is preferably applied to the end face of a horizontal drift or tunnel, however, the end face is formed on a slope rather than in a purely vertical direction. More specifically, most of the working surface at the end face of the tunnel is inclined at an angle of the order of 40 degrees relative to the tunnel floor (or 50 degrees from vertical). The mining tools then reciprocate up and down the sloped surface, in vertical planes.

The present invention also provides a means for cutting a drift or tunnel of substantially rectangular cross-section, thereby making it possible to remove a greater percentage of material from the mine. The mining machine, as it advances in a horizontal direction, continuously extends the floor, walls, and ceiling of the tunnel.

DRAWING SUMMARY

FIG. 1*a* shows the end face of a circular bore hole being mined in accordance with a rotary mining technique of the prior art;

FIG. 1*b* is a cross-sectional view of the ore surface taken on line 1*b*—1*b* of FIG. 1*a;*

FIG. 2*a* is a plan view of a rectangular ore surface as it is being mined in accordance with the reciprocating method of the present invention;

FIG. 2*b* is a cross-section of the ore surface taken on line 2*b*—2*b* of FIG. 2*a;*

FIG. 23 is a view like FIGS. 21 and 22 but showing the mining machine at an intermediate point of movement;

FIG. 24*a* is a schematic view of a simplified form of mining tool including a raised wheel and a tooth engaging the ore surface; and FIG. 24*b* is a schematic view of the tool of FIG. 24*a* showing the tooth and the wheel in reversed positions.

ROTARY MINING (PRIOR ART)

Figure 1A:
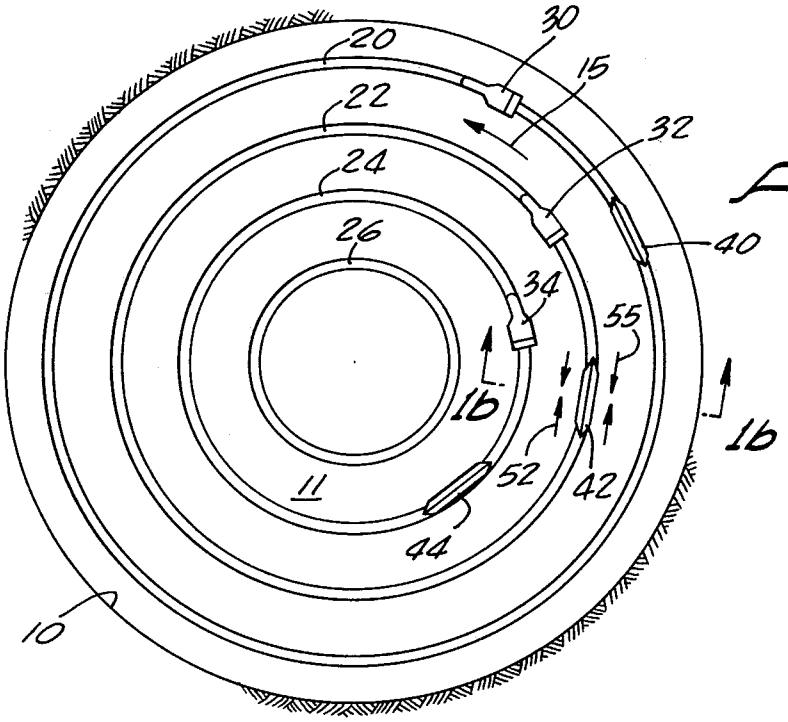
Figure 1B:
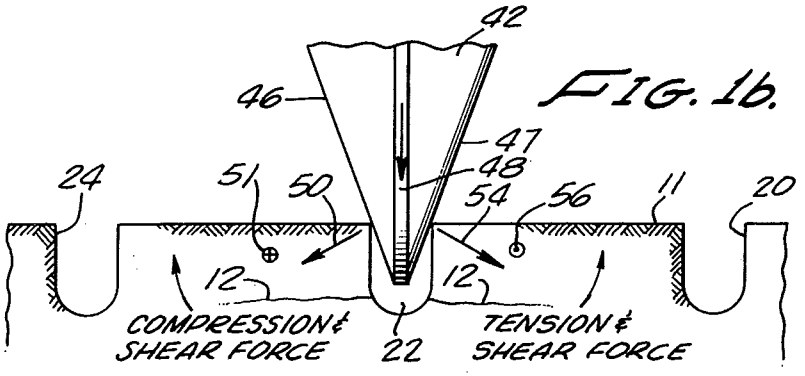

Reference is made to drawing FIGS. 1*a*, 1*b* illustrating a rotary mining method that has been known in the prior art.

A circular bore hole 10 has an end face 11 upon which a mining action is being performed. The bore hole 10 may, for example, be a substantially horizontal tunnel, or it may have a significant amount of vertical inclination upward or downward. The end face 11 constitutes a relatively flat ore surface from which ore material is to be mined. A plurality of grooves 20, 22, 24, 26 are formed in the ore surface 11, which are circular, concentric to each other, and concentric to the longitudinal axis of the bore hole. Groove 20 is the largest in diameter and is relatively close to the circumferential wall of the bore hole 10, while grooves 22, 24, and 26 are of progressively smaller diameters.

A mining tool structure, not fully shown, includes a plurality of cutting teeth 30, 32, 34 and also a plurality of wheels 40, 42, 44. Although not specifically shown, each of the wheels is mounted for rotation relative to the mining tool structure of which it is a part, and is free to rotate about a radius line extending outward from the longitudinal axis A of the bore hole and parallel to the end face 11. Each of the cutting teeth, however, is fixedly supported from the mining tool structure. The purpose of the cutting teeth is to cut the respective grooves deeper, while the purpose of the wheels is to break or dislodge the ore material which lies to the sides of the grooves as will be subsequently explained.

Cutting tooth 30 rides within the groove 20 for the purpose of continuously deepening the groove, and is followed at a relatively short distance by the wheel 40 whose edge is received within the groove 20 so that the wheel rolls along the groove. Tooth 32 rides within the groove 22 for purpose of continuously deepening the groove, and is sequentially followed at a fairly short distance by the wheel 42 which rolls within the groove 22. In similar fashion the tooth 34 rides within the groove 24 for the purpose of continuously cutting it deeper, and is followed by the wheel 44 which continuously rotates as it rolls around the groove 24. The entire mining tool structure rotates in a counterclockwise direction, as seen in FIG. 1*a*, this direction of rotation being represented by an arrow 15. The cutting teeth are mounted on the tool structure in such a way that they do not all lie at the same circumferential location. More specifically, the circumferential position of the tooth 32 is about mid-way between the circumferential positions of tooth 30 and wheel 40. The circumferential position of tooth 34 is about mid-way between the circumferential positions of tooth 32 and wheel 42, and is also slightly behind the circumferential position of the wheel 40. Wheel 42 is about mid-way between the circumferential position of tooth 34 and the circumferential position of wheel 44. Each wheel has a circumferential edge portion which is of wedge-shaped configuration in the radial direction, and this wedge shape is essential to the breaking or dislodging function that the wheel performs.

FIG. 1*b* shows the circumferential edge portion of wheel 42 and how it rolls within the groove 22. Wheel 42 has radially tapering side surfaces 46, 47 whose included angle is an acute angle of the order of 40°. The sloped side surfaces 46, 47 lead to the edges of a flat circular rim 48 which constitutes the radial extremity or circumferential edge of wheel 42.

As shown in FIG. 1*b* each of the grooves 20, 22, 24 is of generally rectangular cross-sectional configuration, but being concavely rounded at its bottom. The shape of the grooves is determined by the shapes of the respective cutting teeth 30, 32, 34 whose cross-sectional configurations are the same as shown for the grooves which they have cut.

As shown in FIG. 1*b* the edge portion of wheel 42 extends into the groove 22 but there is no tool which occupies the adjacent portions of the radially outward groove 20 or the radially inward groove 24. The cutting teeth and wheels are intentionally staggered in the circumferential direction so that each wheel has empty grooves on both its lateral sides. For purpose of the present description of the operation of wheel 42, the groove 22 may be referred to as the central groove while the grooves 24, 20 are collectively identified as the relief grooves.

As shown in FIG. 1*b*, the rim 48 has a thickness which is a great deal less than the lateral width of groove 22. Therefore, the tapered side surfaces 46, 47 of the wheel 42 engage and push against the upper edges of the lateral walls of the groove, and thereby apply outward and downward crumbling forces to the ore material. A sloped arrow 50 in FIG. 1*b* represents the laterally outward and downward force which wheel surface 46 applies on the left side of the groove (as seen in FIG. 1*b*), while the sloped arrow 54 represents the laterally outward and downward force applied to the ore material on the right hand side of the groove by the tapered side surface 47. A wavy line 12 shown in FIG. 1*b* extends generally parallel to the flat ore surface 11 and at about the bottoms of all the grooves. The line 12 represents a rupture plane along which it is hypothetically most likely that the ore material will rupture or break. When and as this action occurs, ore material on the right hand side of the wheel (as seen in FIG. 1*b*) is free to move or shift laterally into the groove 20 while ore material on the left hand side of the wheel (as seen in FIG. 1*b*) is free to shift laterally into the groove 24.

There is, however, a complicating factor in respect to the dislodging or breaking action produced by the wheel 42. The radially inward force (arrow 50) produced by the wheel tends to induce a circumferential compressive force within the ore material as indicated in FIG. 1*a* by the opposed arrows 52 and in FIG. 1*b* by the crossed circle 51. The reason for the circumferential compression is that wheel 42 does not travel in a straight line, but travels about the arc of a circle, and hence the radially inward force arrows 50 which correspond to different positions of the wheel 42 around the circumference of the circle tend to converge towards each other.

An essentially opposite action takes place on the radially outward side of the wheel. Thus the radially outward force indicated by arrow 54 in FIG. 1*b* tends to induce circumferential tension within the ore material. This is indicated by arrows 55 in FIG. 1*a* which pull away from each other and by dotted circle 56 in FIG. 1*b*.

The mining method illustrated in FIGS. 1*a*, 1*b*, therefore results in a non-uniform breaking or dislodging of the ore material. The ore material on the radially inward side of the wheel 42 is more difficult to dislodge or break because of the circumferential compressive force within it, while the ore material on the radially outward side breaks or dislodges much more easily. This results in dissimilar quantities of ore material being dislodged on the respective lateral sides of the groove 22, and it also results in a greater variation in the sizes of the dislodged particles than might otherwise be the case.

In the mining method as illustrated in FIGS. 1*a*, 1*b*, the central or radially inward portion of the ore surface 11 is cut by a different type of cutter, not presently illustrated.

RECIPROCATING METHOD OF THE PRESENT INVENTION (SCHEMATIC)

Figure 2A:
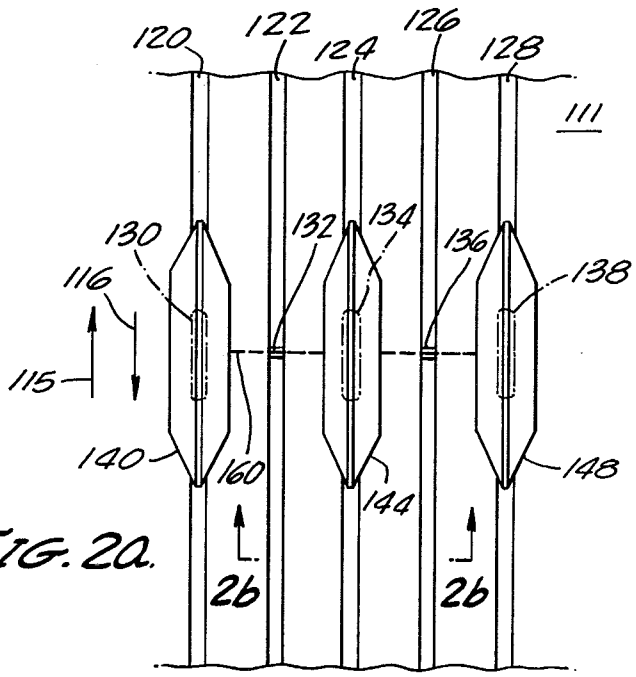
Figure 2B:
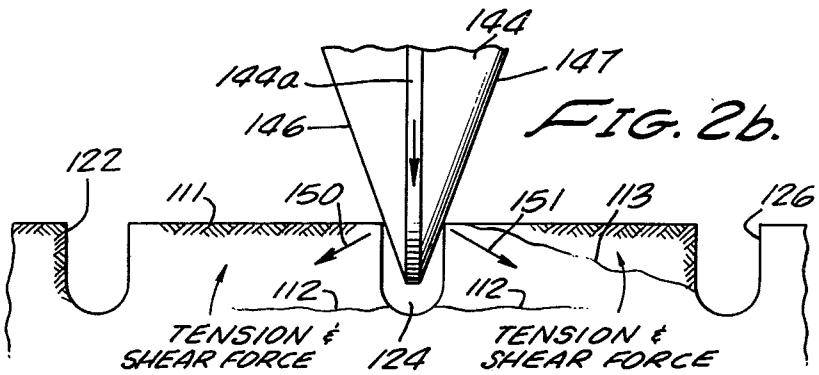

Reference is now made to FIGS. 2*a* and 2*b* which together provide a somewhat abbreviated illustration of the reciprocating mining method of the present invention.

An ore surface 111 is a substantially flat surface area of rectangular configuration, and has grooves 120, 122, 124, 126, 128 formed therein which are substantially straight throughout their length and are parallel to each other. In particular, groove 124 is considered as a central groove while the immediately adjacent grooves 122, 126 are considered as relief grooves.

Individual mining tools are associated with the respective grooves 120 to 128, inclusive. All of the mining tools are part of a mining machine which is schematically indicated by a dotted line 160 which ties all of the tools together. The mining machine 160 moves over the ore surface 111 in a reciprocating fashion, in a forward stroke as indicated by arrow 115 followed by a rearward stroke as indicated by arrow 116, and then a repetition of the forward stroke, and so on.

As shown in FIG. 2*a*, wheels 140, 144, 148 roll within the grooves 120, 124, 128, respectively. Also associated with groove 120 is a cutting tooth 130, illustrated in dotted lines only. Cutting teeth 134, 138 are in like manner associated with the grooves 124, 128, respectively. A scalper tooth 132 moves within groove 122, and a scalper tooth 136 moves within groove 126.

The mode of operation of the mining machine 160, only partially illustrated in FIG. 2*a* and 2*b*, is as follows. When the machine moves in the forward direction as indicated by arrow 115 all of the teeth ride within their respective grooves, and perform a cutting action for deepening the grooves. Thus the cutting tooth 130 rides in groove 120, scalper tooth 132 rides in relief groove 122, cutting tooth 134 rides in central groove 124, scalper tooth 136 rides in relief groove 126, and cutting tooth 138 rides in groove 128. At the same time the wheels 140, 144, 148 are kept out of rolling engagement with their respective grooves. During the return or rearward stroke 116, however, the operation of the mining machine 160 is inverted or reversed. None of the teeth are then in engagement with their respective grooves, but all of the wheels 140, 144, 148 do roll within their respectively associated grooves.

As shown in FIG. 2*b* the wheel 144 has a wedge-shaped circumferential edge defined by the wheel outer surfaces 146, 147. The included angle between the surfaces 146, 147 is preferably about 10° to 40°. These surfaces converge to the lateral edges of a circumferential rim 144*a* which defines the radial extremity of the wheel. As shown in FIG. 2*b* the width of the wheel rim 144*a* is relatively small compared to the width of groove 124; during the return stroke 116 of mining machine 160 the wheel surfaces 146, 147 therefore engage the upper edges of the respective groove walls. Arrow 150 indicates the laterally outward and at the same time downward force which the wheel surface 146 applies to the left-hand wall of groove 124 as seen in FIG. 2*b*. A slightly wavy line 112 located at about the bottoms of all of the grooves indicates the location of the most probable fracture or rupture of the ore material. Thus when the ore material ruptures, the forces identified by arrow 150 will cause the ore material to move leftward so as to at least partially occupy the relief groove 122.

In similar fashion the outward and downward force exerted by wheel surface 147 on the right-hand wall of groove 124 is indicated by an arrow 151. Again, upon rupture of the ore material it will be at least partially moved into the relief groove 126.

Although the line 112 indicates the most probable location of fracture or rupture of the ore material, it is by no means the only possible or probable fracture location. In FIG. 2*b* a slightly wavy line 113 extends from the upper edge of the right-hand wall of groove 124 in a lateral and also downward direction to a point near the bottom of relief groove 126. The line 113 represents a fracture plane which is nearly as probable as the fracture plane 112. The laterally outward component of force generated by the wheel surface 147 tends to apply a lateral shear force to the upper portion of the ore material, pushing it toward the relief groove 126, and this pushing action tends to cause tensile stresses to develop along the plane 113 and perpendicular to that plane, with the result that fracture of the ore material along the plane 113 is rather probable.

The mining method of the present invention as illustrated in FIGS. 2*a* and 2*b*, and described in conjunction therewith, is characterized by lateral symmetry, that is, the straightness of the grooves causes the rupturing or dislodging action upon the ore to be the same on the left-hand side of wheel 144 as it is on the right-hand side of the wheel. Therefore, dislodged ore particles tend to be of rather uniform size.

When the ore particles are to undergo a refining process, as in the case of oil shale, uniformity of the particle sizes is very important. Non-uniform particle size causes the refining process to be far more complex and far more expensive. It is therefore an important feature of the present invention that the reciprocating mining action taken along parallel, generally straight grooves, with a tooth cutting action in one direction and a wheel wedging action in the opposite direction, is inherently capable of producing more uniform particle sizes than the mining methods heretofore used.

Another important characteristic of the reciprocating method of the present invention is that the cutting load is distributed quite evenly amongst the various cutting elements. Thus, each cutting tooth bears approximately the same load as every other cutting tooth, and each wedging wheel bears approximately the same load as every other wedging wheel. Consequently, all of the cutting elements of the mining machine tend to wear at substantially the same rate. The operating time between shut-downs of the machine for purpose of repairing or replacing worn cutting elements is therefore significantly lengthened.

SIMPLIFIED TOOL STRUCTURE

Reference is made to FIGS. 24*a* and 24*b* which illustrate a simplified form of mining tool structure in accordance with the present invention. The tool 170 includes an elongated frame member which is pivotally mounted upon a horizontally extending axle 172. A groove G is formed in the surface of ore material O, and axle 172 extends parallel to the ore surface but transversely of the groove.

A cutting tooth 177 is rigidly affixed to one end of the frame member 171, and a wheel 178 is rotatably attached to its other end. A wheel shaft 173 which mounts wheel 178 for rotation extends parallel to the shaft 172.

As shown in FIG. 24*a* the tooth 177 extends within and engages the groove while the wheel 178 is raised up and is out of contact with the ore surface. As indicated by an arrow 175 the tooth 170 is driven in a direction parallel to the groove G so that tooth 177 digs into and further deepens the groove G.

FIG. 24*b* shows the reverse stroke of the tool 170. Here the tooth 177 is raised out of engagement with the ore surface while the wheel 178 extends within and partially occupies the groove G. Tool 170 is now driven in the opposite direction as indicated by an arrow 176. Wheel 178 rides within the groove, its wedge-shaped circumferential edge portion applying laterally outward and downward forces to the groove walls so as to rupture and dislodge the ore material on both sides of the groove, all as previously described.

PREFERRED TOOL

Reference is now made to FIGS. 5 through 12, inclusive, which illustrate the presently preferred form of mining tool in accordance with the present invention. The basic concept of this tool is that it includes a wheel having a wedge-shaped circumferential edge portion, and a cutting tooth, and the cutting tooth is attached to a point on the circumference of the wheel so as to extend radially outwardly relative to the axis of rotation of the wheel.

In accordance with this basic concept, therefore, a single wheel assembly includes both essential parts of the tool, namely, a wheel and a tooth; and the tooth is rigidly and permanently affixed to the wheel. In carrying out the method of the invention, during one powered stroke of the reciprocating motion the tooth of the wheel assembly is placed within the groove of the ore surface and the wheel assembly is held against rotation so that the tooth will deepen the groove. During the opposite powered stroke, however, the wheel is released for rotation about its axis, and after a short distance of travel the wedge-shaped wheel edge rolls into the groove and the tooth which formerly occupied the groove is lifted out of it.

Referring now to FIGS. 5 through 12, inclusive, of the drawings, the wheel assembly WA will be specifically described. In general, the wheel assembly WA is supported upon a shaft SH, the shaft being moved parallel to an ore surface O for cutting a groove G therein. The wheel assembly WA includes a wheel W having a pair of cutting teeth T1, T2 attached thereto at closely adjacent points of its circumference. While in concept a single tooth would suffice, for purposes of a reliable engineering design it is preferred to use a pair of teeth.

Figure 5:
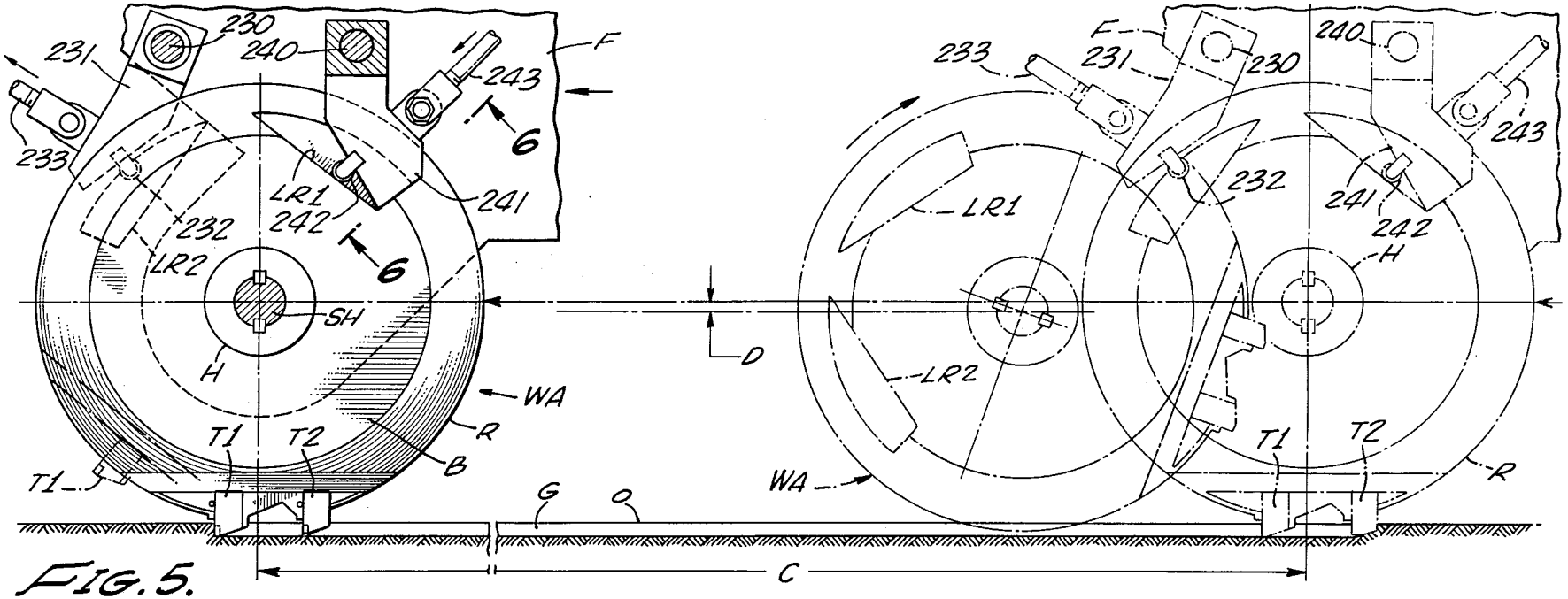
FIG. 5 is an elevation view of a wheel assembly and associated locking mechanism in accordance with the present invention, taken on the line 5—5 of FIG. 3.
Figure 6:
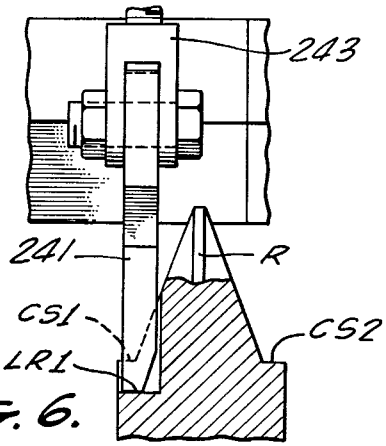
FIG. 6 is a fragmentary cross-sectional view of one of the locking mechanisms taken on the line 6—6 of FIG. 5.
Figure 11:
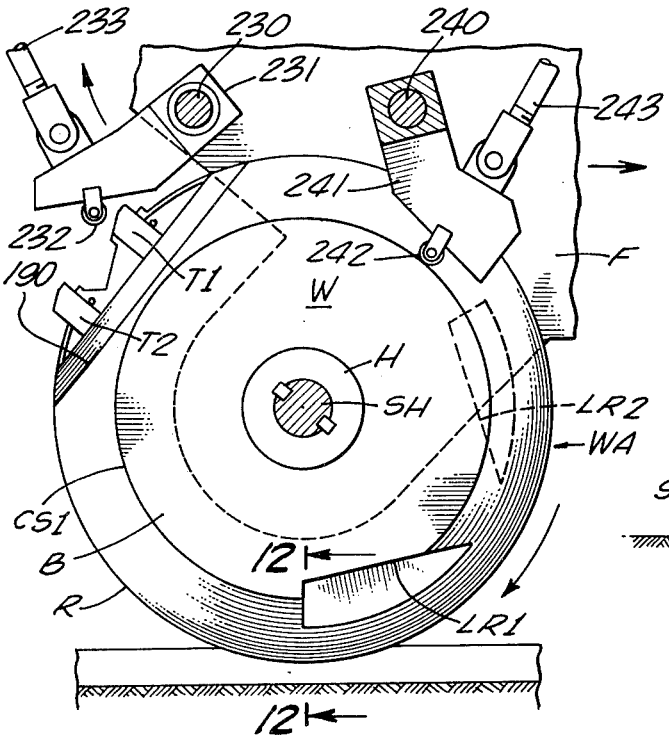
FIG. 11 is another elevational view of the wheel assembly shown in a different rotational position.
Figure 13:
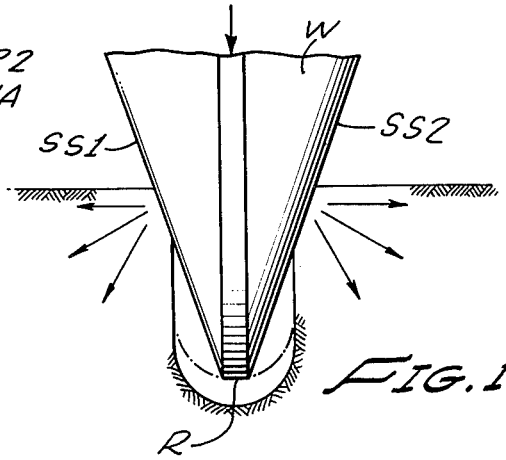
FIG. 13 is an enlarged fragmentary view showing the wedging action of the wheel in a groove.
Figure 18:
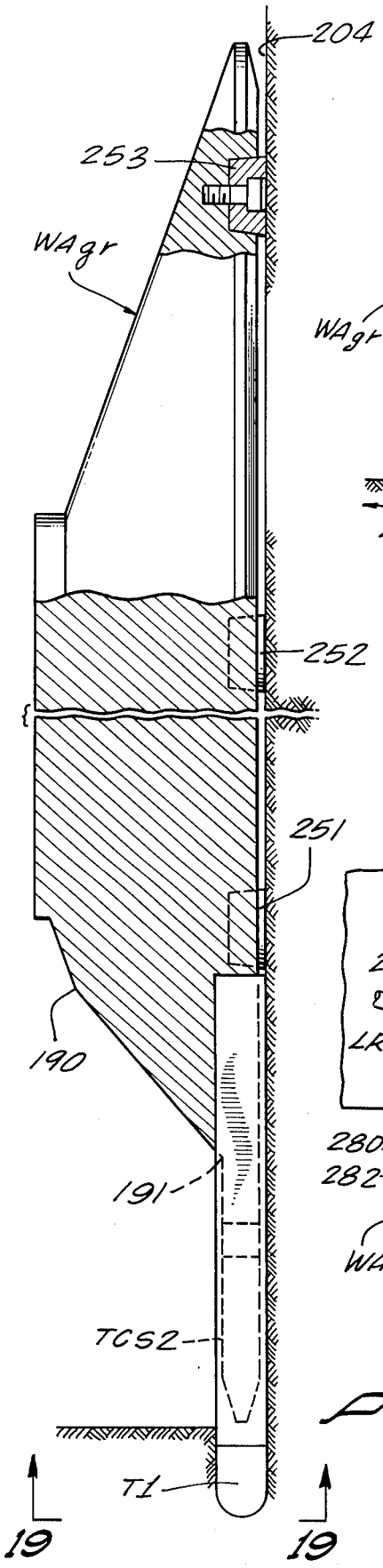
FIG. 18 is a cross-sectional view taken on the line 18—18 of FIG. 17.
Figure 20:
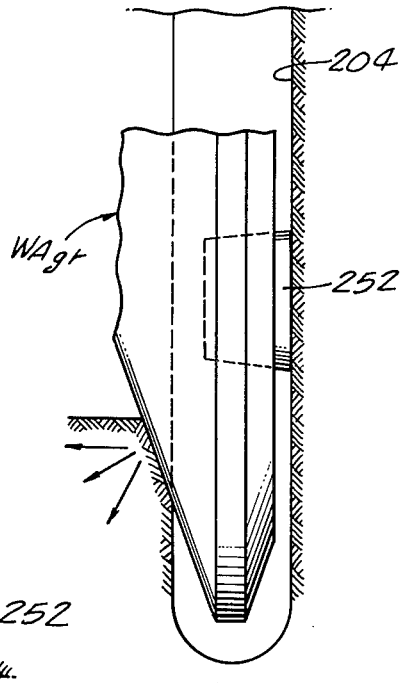
FIG. 20 is an enlarged fragmentary view showing the wedging action of the gauge wheel of FIG. 17 in its associated groove.

Wheel assembly WA is shown in solid lines in the left-hand portion of FIG. 5. The alternate positions of the wheel assembly which are shown in dotted lines in the same figure are not pertinent for the present discussion. Wheel assembly WA is also shown in FIG. 11.

Figure 3:
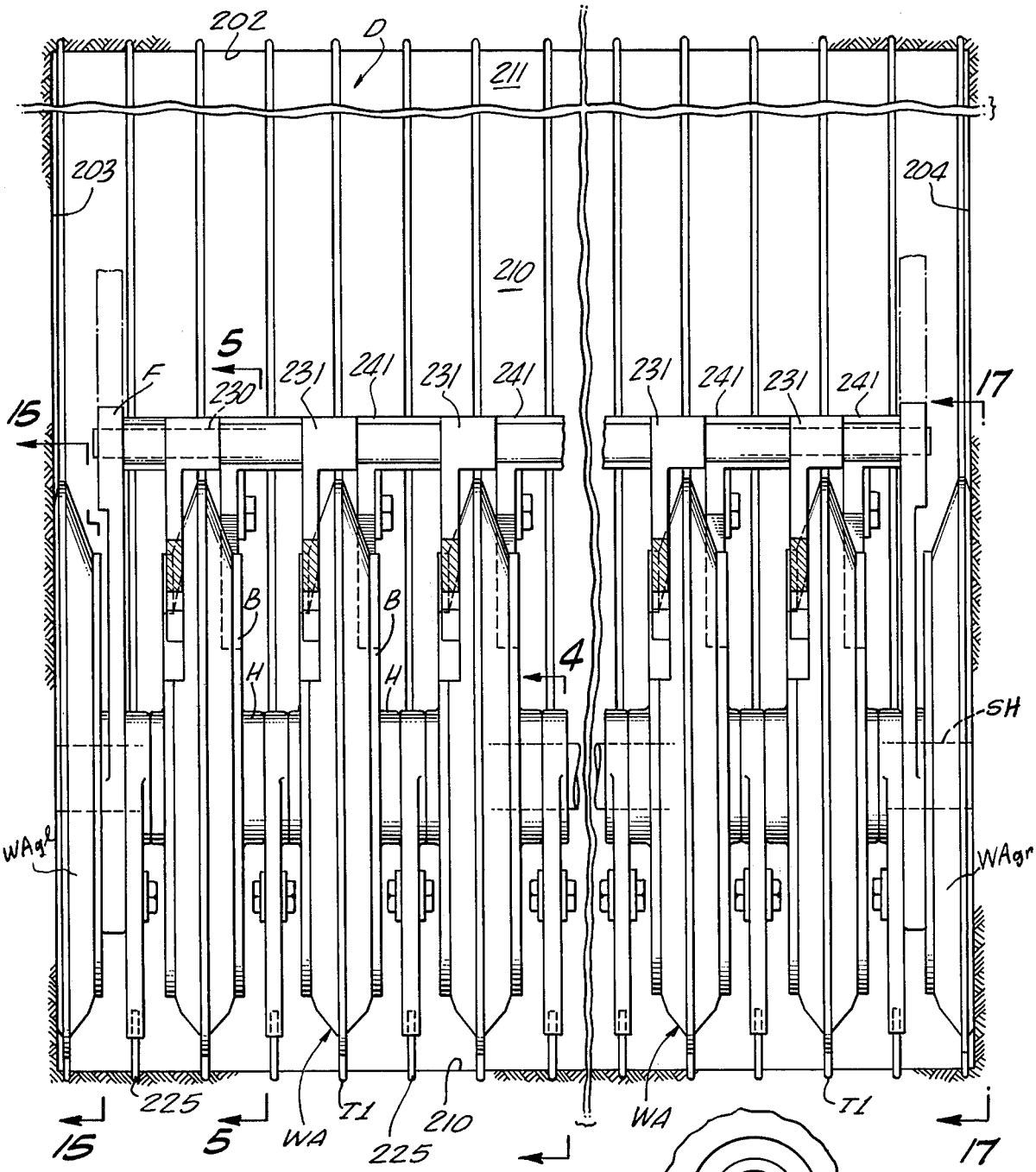
FIG. 3 is an elevational view of a mining machine in accordance with the present invention, as it is cutting a mine tunnel having a rectangular cross-sectional configuration.

Wheel W is preferably manufactured as a single casting and then machined as necessary. As most clearly seen in FIG. 11, a rim R defines the circumferential edge of wheel W. The wheel has a relatively thick base or central portion B whose radius is approximately $\frac{3}{4}$ the radius of the rim R. At the center of the wheel is a laterally protruding hub H whose radius is about $\frac{1}{4}$ that of the rim R. The relative thickness of base B, and the protruding shape of hub H, are best shown in FIG. 3. A central opening in hub H receives the shaft SH, which is keyed to the wheel. While the wheel assembly of the present invention may if desired be so contructed as to rotate about its supporting shaft, it is nevertheless preferred that it rotate with the shaft, for reasons which will be described later.

At the circumference of the base B the wheel W is cut somewhat thinner on both sides, forming a pair of circumferential shoulders CS1, CS2, respectively. Associated with these shoulders are a pair of locking recesses, one on each side of the wheel, the locking recess LR1 being associated with shoulder SC1 while the locking recess LR2 is associated with shoulder CS2. These portions of the wheel construction are utilized in controlling the operation. in order to lock it against rotation during one powered stroke of the reciprocating drive, while releasing it for rotation during the opposite powered stroke of the reciprocating drive.

Figure 12:
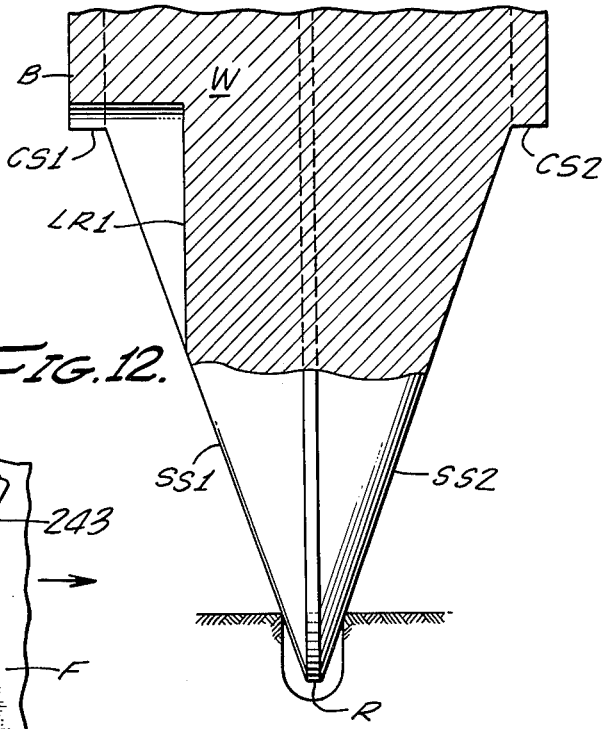
FIG. 12 is a cross-sectional view taken on line 12—12 of FIG. 11.

An outer circumferential edge portion of wheel W, extending from base B to rim R, has a wedge-shaped radial cross-sectional configuration. This portion of the wheel, accounting for approximately ¼ of its radius, is most clearly shown in FIG. 12. FIG. 12 also clearly shows the cam shoulders CS1 and CS2 and the locking recess LR1. Locking recess LR2 is shown in dotted lines both in FIG. 5 and in FIG. 11, recess LR1 being shown in solid lines in both of these figures.

A sloping side surface SS1 extends from cam shoulder CS1 to one side of the rim R, while a sloping side surface CS2 extends from cam shoulder SC2 to the other side of rim R. The included angle between the two sloping side surfaces SS1, SS2 may be about 40°. The lateral width of each cam shoulder CS1, CS2 is about 1/10 or less of the thickness of the wheel base B, and the width of rim R in preferably even less than that of the cam shoulder. The significance of the wedge shape of the wheel has already been described in connection with FIGS. 1*b*, 2*b*, and need not be repeated here.

The preferred mounting arrangement for the cutting teeth T1, T2 occupies only about 20° to 25° of the circumference of wheel W, but in order to make suitable provisions for mounting the teeth the wheel construction is modified throughout about 60° of its circumference. This modification of the wheel structure is best illustrated in FIGS. 7 through 10, inclusive. The wheel is machined on both sides from a first pair of chord lines 190 (FIGS. 7 and 8) to a second pair of chord lines 191, to provide therebetween a sloped chord section SCS. At their longitudinal centers the chord lines 190 are located very near the wheel base B and cam shoulders CS1, CS2 (FIG. 7), while at their outer ends chord lines 190 extend all the way to rim R (FIG. 11).

Figure 7:
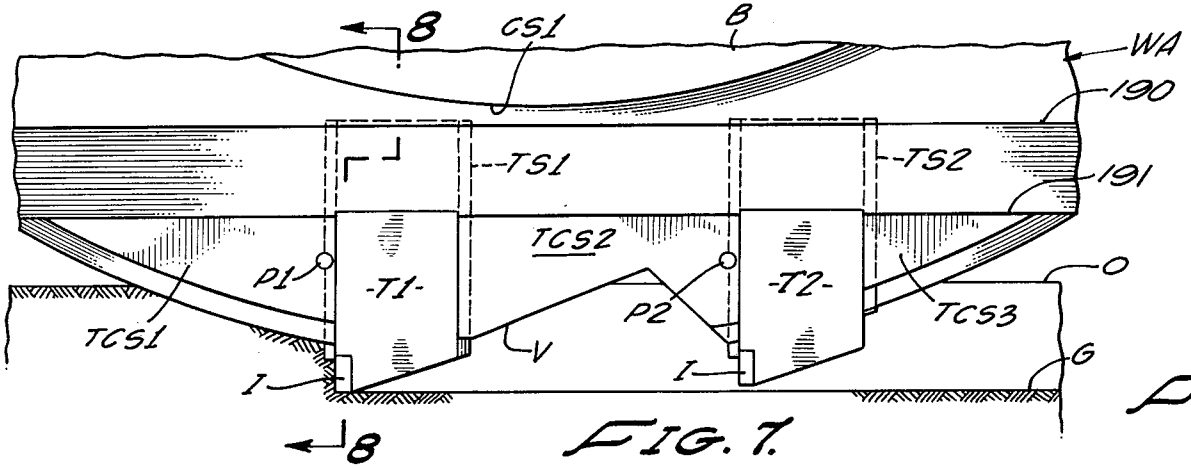
FIG. 7 is an enlarged fragmentary view of the cutting teeth of the wheel assembly of FIG. 5.
Figure 8:
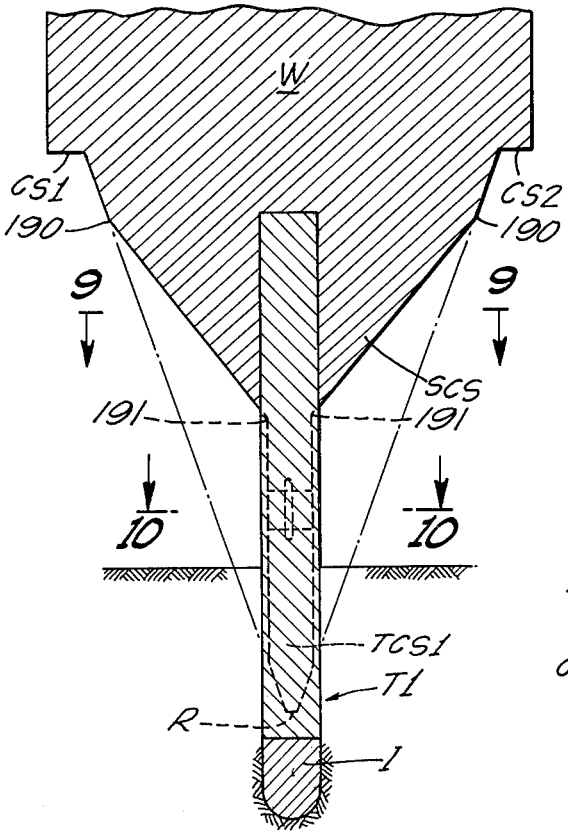
FIG. 8 is a cross-sectional view of the lead tooth taken on line 8—8 of FIG. 7.
Figure 10:
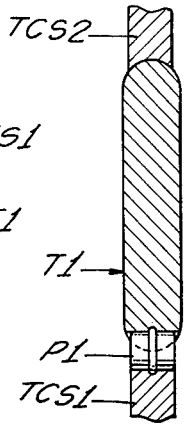
FIG. 10 is a cross-sectional view taken on line 10—10 of FIG. 8.

At the chord line 191 the wheel W is cut to a thickness which is several times the width of the rim R but is somewhat less than the thickness of tooth T1 (FIG. 8). This thin chord section of the wheel is identified as TCS (FIGS. 7, 8 and 10). The installation of the teeth, however, causes the thinned chord section to be cut into three separate parts which are identified in FIG. 7 as TCS1, TCS2, TCS3, respectively.

Figure 9:
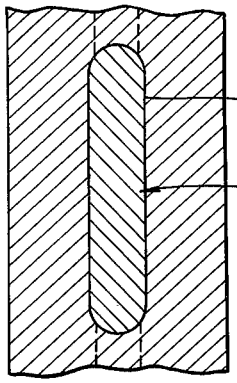
FIG. 9 is a cross-sectional view taken on the line 9—9 of FIG. 8.

Each of the teeth T1, T2 (FIG. 7) includes a tooth body which is in the form of a generally rectangular plate, but with a carbide insert I at the front corner of the lower end of the plate, and the lower end of the plate behind the insert being cut at an angle and sloped upwardly. The longitudinal edges of each tooth body are rounded (FIGS. 9 and 10). After the sloped chord section SCS and the thin chord section TCS have been formed on the wheel W, further machine operations are performed as follows. A tooth socket TS1 (FIG. 9) is milled into the wheel in a direction perpendicular to the chord lines 190, 191, in order to receive the tooth T1. A similar opening TS2 (FIG. 7) is milled in the location which is to receive tooth T2. The forming of these two openings results in the thinned chord section TCS being cut into sections TCS1, TCS2, TCS3, respectively. The radially outward edge of TCS2 is then notched at V. A half-circle is then cut transversely through the rearward edges of TCS1 and TCS2, to subsequently receive pins P1 and P2, respectively.

The forward longitudinal edge of each tooth body is also cut with a semi-cylindrical opening for receiving its respective fastening pin. The fastening pin P1 is shown in solid lines in FIG. 10 and in dotted lines in FIG. 8. Pin P1 is a small cylindrical plug whose outer surface has a circumferential groove at about the longitudinal center of the plug, in which an elastomeric O-ring is received. Each tooth is inserted into the wheel in a substantially radial direction, and then the fastening pin P1 or P2 is inserted in a direction transverse to the plane of the wheel, with one longitudinal half of the pin occupying the recess in the thinned chord section TCS of the wheel while the other longitudinal half of the pin occupies the recess in the tooth body.

It will be noted in FIG. 7 that tooth T2 is slightly shorter than tooth T1. The purpose of the space V which precedes the tooth T2 is to permit cuttings created by tooth T1 to escape from the groove G as tooth T2 advances therein.

Figure 14:
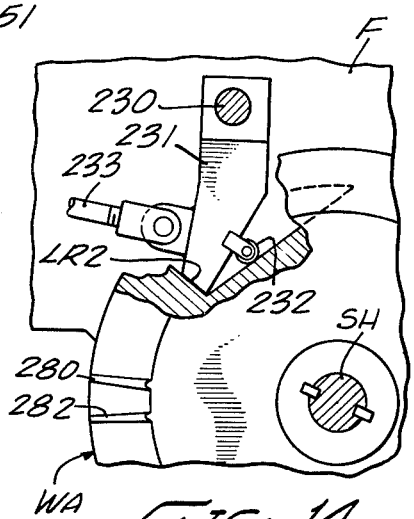
FIG. 14 is a fragmentary view, partially in cross-section, showing one of the locking mechanisms.
Figure 19:
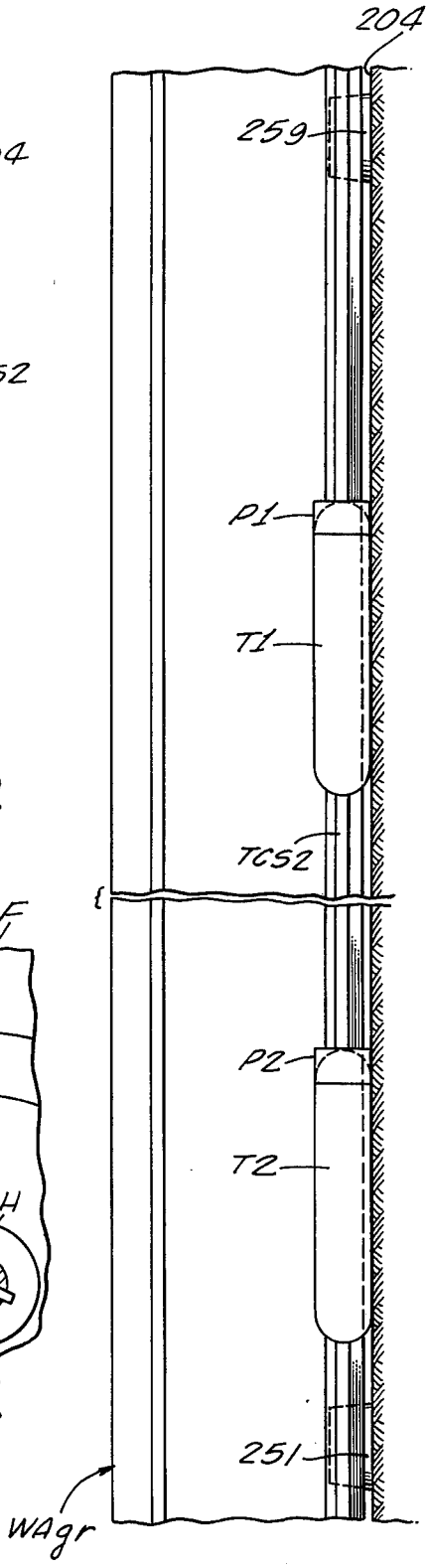
FIG. 19 is a cross-sectional view taken on line 19—19 of FIG. 18.
Figure 16:
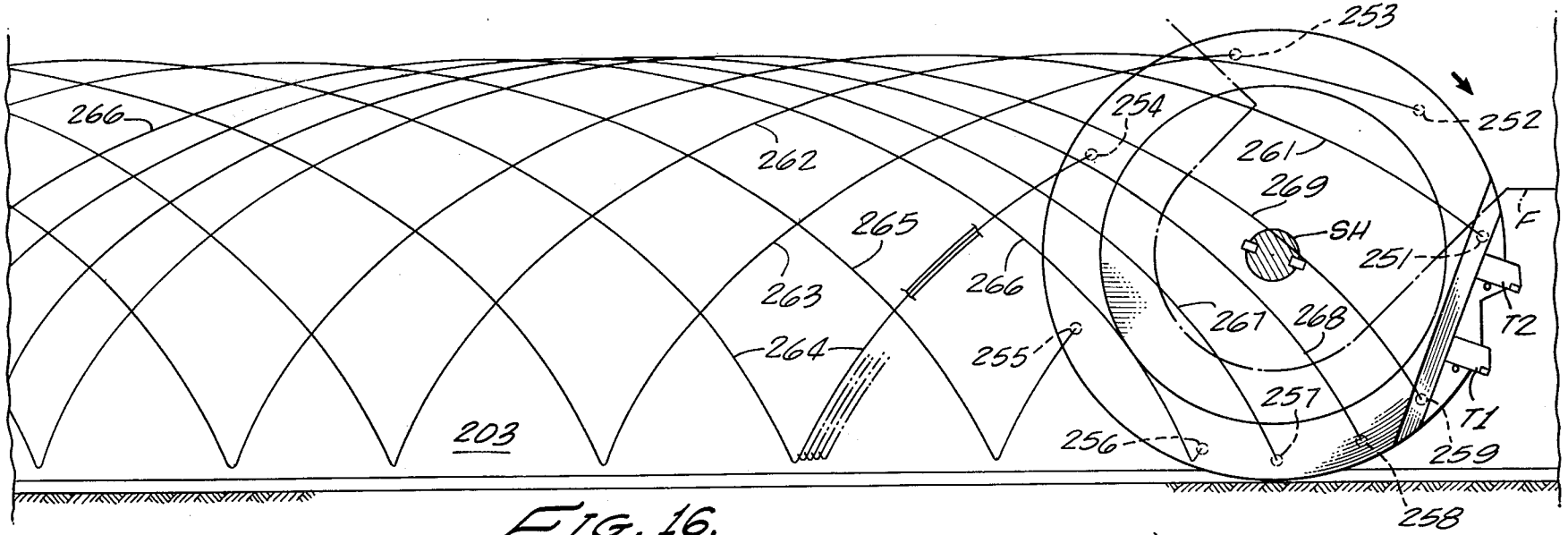
FIG. 16 is an elevation view of one of the tunnel walls showing the cutting pattern of the gauge wheel of FIG. 15.
Figure 17:
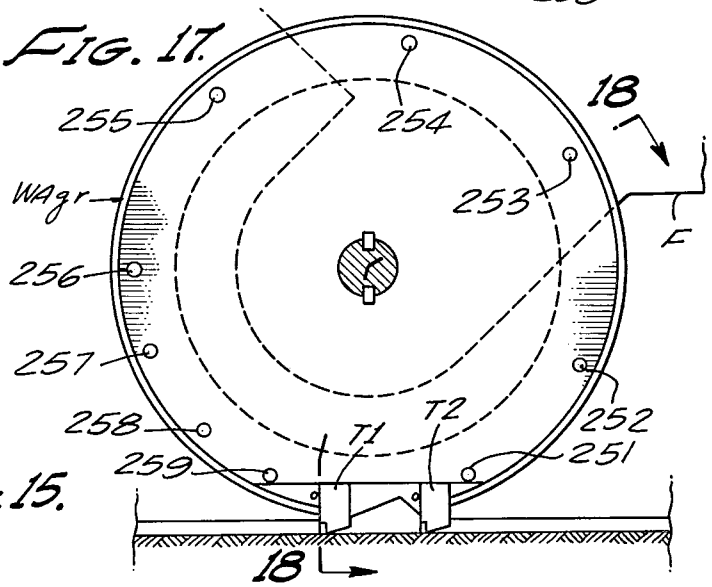
FIG. 17 is an elevation view of the other gauge wheel taken on the line 17—17 of FIG. 3.
Figure 15:
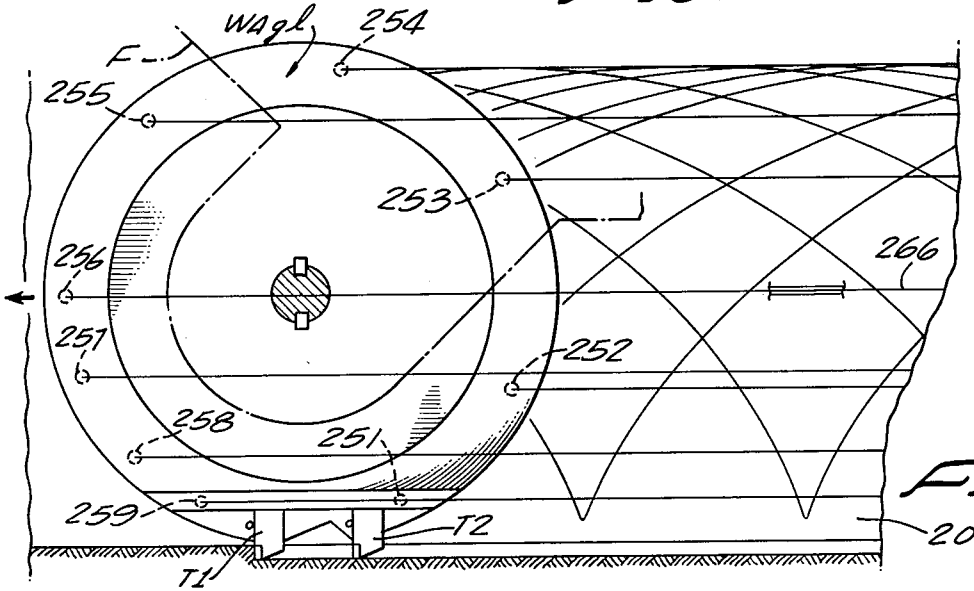
FIG. 15 is an elevation view of one of the gauge wheels taken on the line 15—15 of FIG. 3.

As described thus far the preferred tool of the present invention utilizes a wheel whose circumferential edge portion is wedge-shaped in the radial direction, with the surfaces of the wedge-shaped portion being smooth. It is actually preferred, however, to provide radially disposed ribs on each surface of the wedge-shaped wheel portion. This particular feature of the invention is illustrated only in FIG. 14 where two typical ribs 280, 282, are shown.

The ribs such as 280, 282 are integrally cast as part of the wheel. The ribs are spaced apart around the circumference of the wheel, being preferably separated by several inches or by several degrees of the wheel circumference. While only two such ribs are illustrated, it will be understood that a considerable number are used, and that they are spaced around the entire circumference of the wheel on both sides of the wedge-shaped surface.

The important function of the wheel ribs such as 280, 282, is to concentrate the crushing load that is applied to the upper edges of the groove walls. For example, if the distance between ribs is three times the width of a single rib, then the area of contact with the groove walls may be reduced to as little as ¼ of which it might otherwise have been, thereby increasing the intensity of the applied crushing force (measured in pounds per square inch) to four times what it would otherwise have been. Although the total crushing force remains the same, it is distributed among specific longitudinal segments of the groove walls. The crushing action of the wheel is therefore greatly increased.

In a restricted sense the preferred mining tool in accordance with the present invention is a wheel assembly WA including a wheel W and at least one tooth T1. In its complete form the tool also includes means mounting the wheel for rotation about its axis, and means selectively operable for locking the wheel against rotation in either direction.

In order to incorporate the mining tool into a mining machine, however, a number of tools are placed in laterally spaced positions and are preferably arranged for rotation of all the wheels about a common axis of rotation. Furthermore, all of the wheels are preferably keyed to a common shaft, such as the shaft SH shown in FIG. 3, so that they will either rotate together or else be simultaneously locked against rotation. A control of the rotating or locking action of one wheel then becomes effective for all of the wheels that are keyed to the common shaft.

Figure 4:
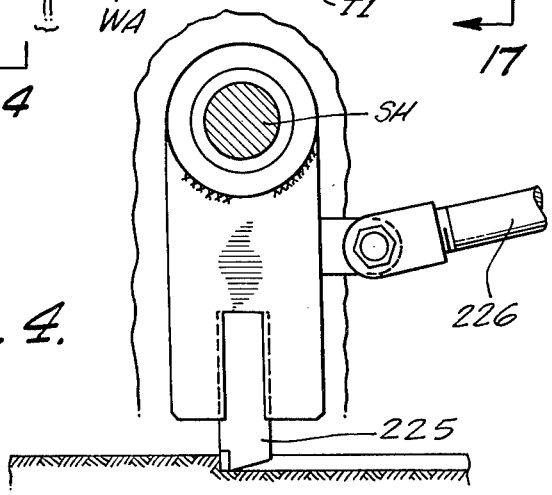
FIG. 4 is a fragmentary cross-sectional view taken on the line 4—4 of FIG. 3, showing a scalper tooth.

In accordance with the reciprocating mining method of the present invention a significant advantage is achieved by providing a relief groove intermediate each two adjacent grooves within which the crushing wheels roll. A convenient method to provide the relief grooves is to utilize a number of scalper teeth 225, such as shown in FIGS. 3 and 4. Each scalper tooth is supported from the shaft SH intermediate to two of the wheel assemblies WA. The body portion of the scalper tooth, however, is not keyed to the shaft SH, but instead is freely rotatable upon the shaft. A control rod 226 is pivotally coupled to the scalper tooth body. The mode of operation is such that each time the teeth T1 are dragged along one alternate set of the grooves, the control rods or arms 226 are held in such position that at the same time the scalper teeth 225 are dragged along the other alternate set of grooves. During the reverse stroke of the reciprocating drive, however, when the wheels of the wheel assemblies are free to rotate, control arms 226 are held in a retracted position so that all of the scalper teeth 225 are held completely out of engagement with the relief grooves.

While the term "groove" has been used above it will nevertheless be understood that the term "kerf" is essentially synonymous, and that for purposes of defining the present invention these two words are considerable to be interchangeable.

MINING UNDERGROUND — THE PREFERRED METHOD

In the preceding portion of this description reference has been made to the mining method of the present invention which is adapted to apply a reciprocating mining action to a substantially flat surface of ore material that is to be mined. While this reciprocating mining method will no doubt have some application for surface mining purposes, its principal advantage is believed to lie in underground mining applications.

The mechanized method of the present invention is well adapted to the mining of substantially horizontal drifts or tunnels. Horizontal tunneling methods have generally involved the cutting of a substantially vertical end face at the end of the tunnel that is being extended or advanced. More specifically, the end face or working surface of the tunnel is usually rather precisely perpendicular to the longitudinal axis of the tunnel portion that has already been cut. In accordance with the present invention, however, it is preferred to form the end face of the tunnel as an incline or slope relative to the tunnel floor. Specifically, it is believed advantageous to utilize an angle of inclination which is of the order of 40° relative to the tunnel floor.

Traditional tunneling method have generally involved utilizing a circular machine for cutting a round or cylindrical tunnel opening. Not so with the present invention. According to the present invention it is preferred to utilize a rectangular heading system, cutting the tunnel or drift with substantially flat floor, ceiling, and side wall surfaces. The tunnel width may exceed the height, or vice versa; or in a particular case the tunnel may be square and these two distances are equal.

In applying the reciprocating mining method of the present invention to underground mining, therefore, it is preferred to have the mining machine and its mining tools reciprocate up and down a sloped working surface that is formed at the end of the tunnel which is being advanced or extended. The cutting away of the material on this sloped working surface results in the extension of the tunnel. The parallel grooves which are formed in the ore surface extend lengthwise of the tunnel. The individual mining tools (wheel assemblies) then reciprocate upward and downward in respective grooves, each mining tool reciprocating in a separate vertical plane.

There are several significant advantages of this method of underground mining. One advantage is that the force of gravity may, to a considerable extent, be utilized for generating the pressure levels that are required for effective mining. The general concept of this approach has been disclosed in my U.S. Pat. No. 3,776,594 issued Dec. 4, 1973 entitled "METHOD FOR MECHANIZED SEAM MINING." As described in that patent, a mining machine or broach may advantageously be provided with a parasite weight load, to augment the weight of the broach or machine itself, and the magnitude of this parasite load may be adjusted as the mining action progresses.

Another advantage of this method lies in the fact that anchoring of the mining machine to the side walls of the tunnel is not necessary. The mining machine or broach is driven up the inclined slope at the end of the tunnel, and then is allowed to move back down the slope for its forward stroke, during which the cutting portion of the mining action takes place. The immense forward thrust required by conventional tunneling machines, which in turn requires side wall anchoring, has no counterpart in the present method.

Still another important advantage of the present underground mining method is the high percentage of recovery of the ore material that can be achieved. The rectangular heading removes a greater amount of ore than would be removed by a cylindrical tunnel of the same diameter. At the same time there is no blasting or other similar activity that would impair the structural capability of the rock walls that are allowed to remain in the mine between the drifts or tunnels.

Figure 21:
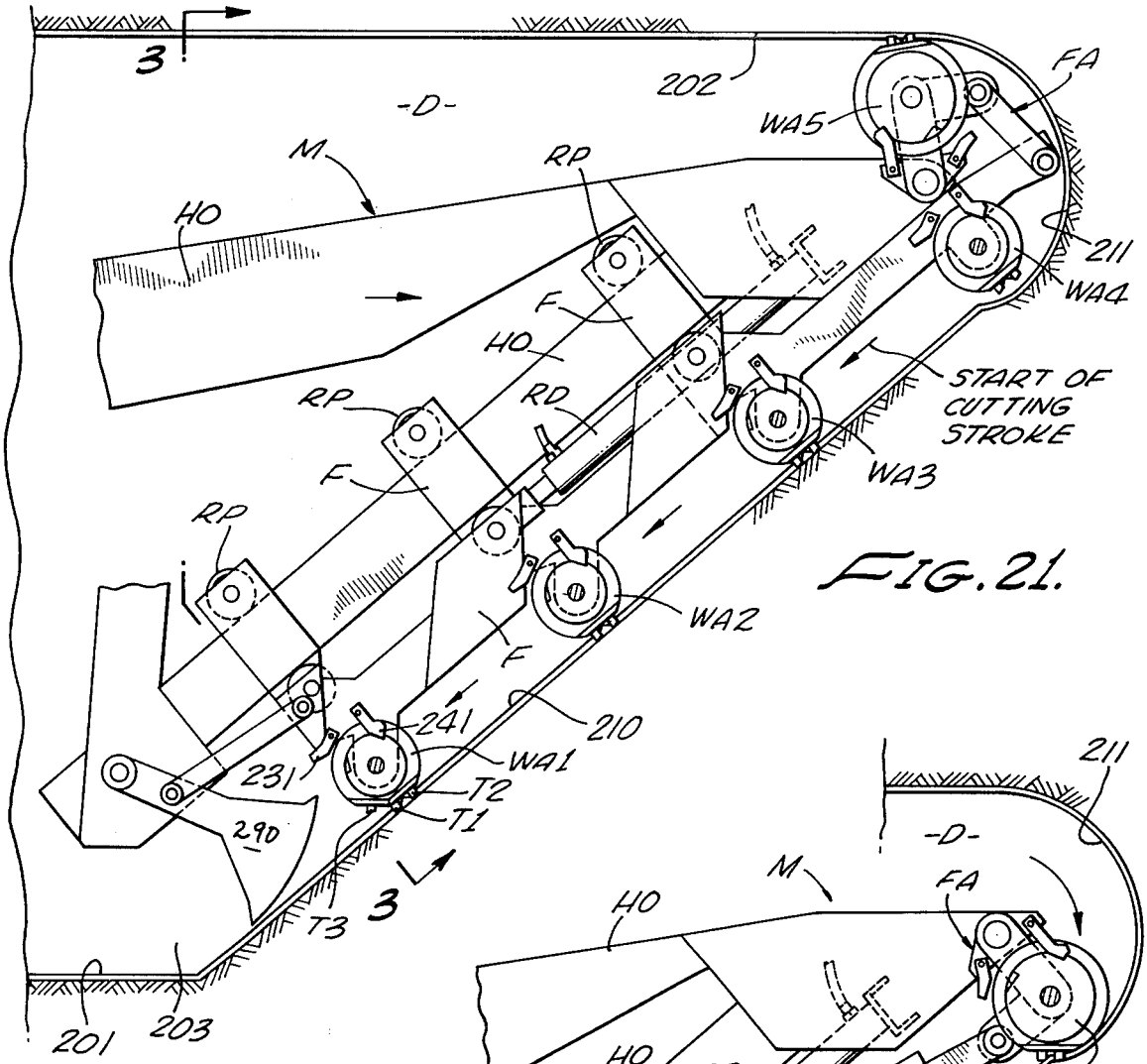
FIG. 21 is a longitudinal cross-sectional view of a tunnel as it is being cut in accordance with the method of the present invention, and showing the mining machine therein at the upper end of its stroke upon a sloping end face of the tunnel.
Figure 22:
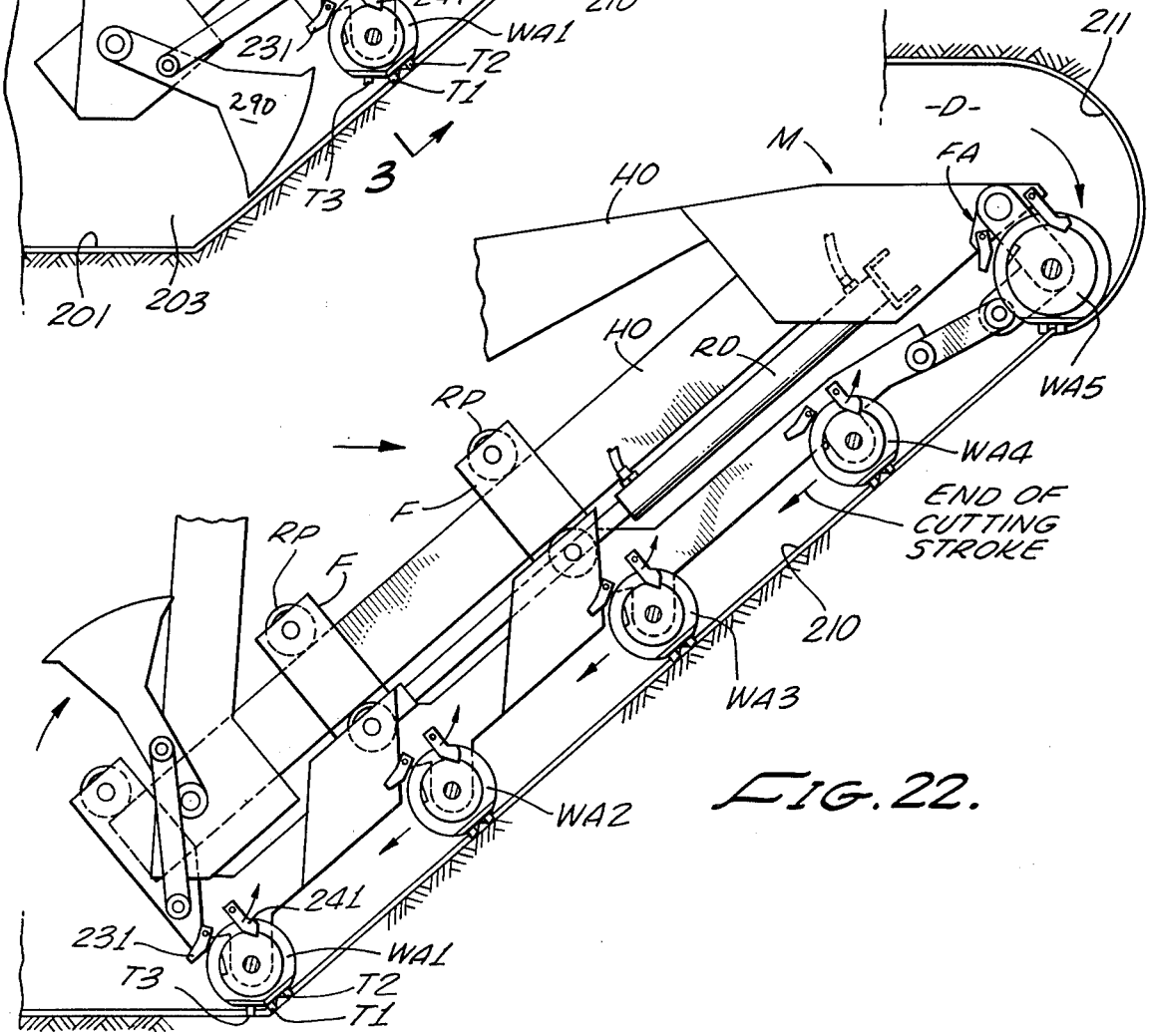
FIG. 22 is a view like FIG. 21 but showing the mining machine at the lower end of its reciprocating stroke.

In accordance with the underground mining method of the present invention the rectangular heading and sloped working surface are particularly shown in FIGS. 3 and 21–23. Thus the tunnel D has a floor 201, ceiling 202, left side wall 203, and right side wall 204, each of which is a substantially flat surface. Most of the mining action at the forward end of tunnel D occurs on the sloped working surface 210 which is a substantially flat surface (FIGS. 21–23). However, there is also a curved surface 211 at the upper end of flat surface 210, which is continuously worked by the mining machine M as the tunnel is advanced.

THE MINING MACHINE

Reference is now made to drawing FIGS. 3 through 23, inclusive, which illustrates the presently preferred mining machine in accordance with the present invention.

As best seen in FIGS. 21–23, mining machine M includes a relatively stationary housing HO which, however, is progressively advanced as the mining action takes place. Housing HO may, for example, be supported and advanced by a conventional crawler. As shown in FIGS. 21–23 the working surface 210 is inclined upward at an angle of about 40° from the floor 201 of tunnel D. A lower portion of housing HO is spaced above the working surface 210 but extends substantially parallel to it. Between this lower part of housing HO and the working surface 210 is an elongated frame or carriage F. The frame F is supported upon several sets of wheel assemblies which are designated as WA1 . . . WA4, respectively. These sets of wheel assemblies, in turn, rest upon the working surface 210 in order to provide support both for themselves and for the frame F. Frame F is also equipped with pairs of upstanding extensions which encompass the sides of the lower part of housing HO, and these extensions also carry roller pairs RP which rollingly engage the housing HO. Thus the housing HO and the frame or carriage are effectively coupled together as a single unit, with the frame F being adapted to reciprocate longitudinally relative to housing HO and being well supported for that purpose by the roller pairs RP.

Near the upper extremity of the frame F a set of hydraulic drive cylinders RD extend between and parallel to the frame F and the lower portion of housing HO. The lower ends of cylinders RD are attached to frame F while their upper ends are secured to housing HO. Cylinders RD are powered and controlled, by means not shown, so as to provide the desired reciprocating drive motion of the frame F relative to the housing HO.

An auxiliary frame FA is coupled between the upper end of frame F and the upper extremity of housing HO. The auxiliary frame FA has an articulating action which enables it not only to support a set of wheel assemblies WA5, but also to control the movement of the wheel assemblies WA5 so that they progressively work the curved surface 211 at the forward end of tunnel D. As will be seen in FIGS. 21–23, the curved surface 211 merges smoothly with the forward end of tunnel 202, and hence progressively extends the tunnel ceiling as the mining action continues.

In the mining machine M it is preferred to synchronize the rotation of all the wheel assemblies WA, including all of the wheel assemblies in all of the sets WA1 . . . WA5, inclusive. As far as a particular set of laterally spaced wheel assemblies is concerned, this is easily accomplished by permanently keying all of the wheel assemblies to a common shaft SH, as previously described. It is then preferred to couple all of these shafts together by means of an interconnecting chain and sprocket mechanism, not shown in the present drawings. The result of this arrangement is that while there may be some slippage of an individual wheel relative to the surface of the ore material being mined, all of the wheels will nevertheless rotate in synchronism, and hence any slippage which does occur will apply to all of the wheels rather equally.

Insofar as the tunnel D is concerned the forward direction of movement is to the right as seen in FIGS. 21–23, or in the upward direction relative to the sloped working surface 210. The "forward" direction for machine M and the individual mining tools, however, is downhill rather than uphill. This action will now be explained.

Each of the wheel assemblies WA is allowed to rotate when the frame F moves up the sloped working surface. The wedge shaped circumferential edge of the associated wheel therefore rolls along within the respective groove that has previously been formed in the working surface. This condition of the machine is shown in FIG. 23. The upward movement of frame F continues until its upper limit position is reached, as shown in FIG. 21. The machine then prepares itself for the cutting stroke, which will take place when frame F moves down the sloped working surface 210.

As the machine prepares to reverse its direction, all of the wheel assemblies WA1 . . . WA5 are locked against rotation. They are locked in such a position that the teeth T1, T2 on each wheel assembly engage the respectively associated groove in the ore material. Frame or carriage F then moves down the hill (the inclined working surface 210) in its cutting stroke, which is also considered the forward stroke insofar as the individual mining tools WA are concerned. This movement continues until frame F reaches its lower limit position as shown in FIG. 22. The wheel assemblies are then unlocked in preparation for their return movement up the hill (sloped working surface 210) when they will again roll freely along within the respectively associated grooves. The specific mechanism for locking and unlocking the wheel assemblies is described in a separate section of this description.

Wheel assemblies WA1 have a special function, which is to continuously extend the tunnel floor 201. Each of the wheel assemblies WA1 is therefore provided with a tooth T3 in addition to the standard teeth T1, T2 (FIGS. 21–23). Tooth T3 is positioned forward or ahead of tooth T1, in the sense of the "forward" direction for the individual mining tools. The operation of the machine is synchronized in such fashion that, at the lower end of its cutting stroke, teeth T1 and T2 engage the sloped working surface 210 while the tooth T3 engages the tunnel floor 201. See FIG. 22. The result of this operation, as the mining action continues, is that teeth T3 of the wheel assemblies WA1 continuously extend the tunnel floor. It will be noted that the circumferential position of tooth T3 differs from the circumferential position of tooth T1 by approximately 40 degrees, the same angle that constitutes the angle of inclination of the sloped working surface 210. While the illustrated method of extending the floor surface is applied to a particular angular relationship, it will nevertheless be understood that this method may generally be applied to any two working surfaces which join each other at an angle of less than 180 degrees.

It will be understood that when the frame F moves upward, and all of the wheels roll within their respective grooves, the weight of the entire machine then rests upon the walls of the grooves. The effective weight of the machine is subject to considerable control and modification by adding or subtracting parasite weight loads (not specifically shown), or by varying the forward drive force applied to the stationary housing HO, or both. As mining progresses, the mined material is continuously removed by scoop 290, FIG. 21.

GAUGING THE SIDE WALLS

The method and apparatus for cutting or gauging the side walls of the tunnel D is shown in FIGS. 3 and 15–20. Each wheel assembly on one of the lateral ends of the shaft SH is provided with an outer surface that is substantially flat. As seen in FIG. 3, wheel assembly WAg1 (wheel assembly gauge left) has a flat surface on its left side. It engages and continuously dresses the left side wall 203. The wheel assembly WAgr (wheel assembly gauge right) has a flat surface on its right hand side. It continuously cuts and dresses the right side wall 204.

The structure of wheel assembly WAgr is shown in detail in FIGS. 17–20, inclusive. As there shown, a number of carbide cutters 251 . . . 259 are held in sockets in the outer flat surface of the wheel, being circumferentially spaced about the wheel and relatively close to its radial extremity. Other details of the construction are clear from the drawings and do not require further description. It will be noted that the gauge wheel is constructed in such manner as to function the same as the other wheel assemblies insofar as cutting the groove in the tunnel floor is concerned. It has substantially the same wedge-shaped radial configuration, except that all of the slope of the wedge is on one side while its other side is flat. The relationship between cutting teeth T1, T2 and the wheel is essentially the same as for the regular wheel assemblies. In addition, however, it has the other flat side in which the carbide bits are supported.

The structure of the gauge wheel WAg1 is the same, except that its flat side faces to the left rather than to the right. The operation of the gauge wheel WAg1 is shown schematically in FIGS. 15 and 16. It will be seen that the pathways of the various carbide bits produce, as the wheel rotates, a set of crisscrossing pathways on the left side wall 203 of the tunnel. As the mining action continues, the point at which the rolling action of the wheel commences is itself progressively advancing. Therefore, the two sets of crisscrossing pathways on the tunnel side wall which are generated during one of the reciprocating movements of frame F along working surface 210 are advanced slightly relative to the immediately preceding sets of criss crossing pathways.

THE WHEEL LOCKING ACTION

Reference is now made to drawing FIGS. 5, 6, 11, 12, 14, 21, and 22 which illustrate the wheel locking action. There are two separate locks associated with each wheel. For convenience these are referred to as the downhill lock and the uphill lock, respectively. The construction and operation of the downhill lock will be described first.

A locking recess LR1 is associated with the cam shoulder CS1 (FIGS. 5, 6, 11, 12). A clutch plate 241 is pivotally supported on shaft 240 carried by the frame F, in such position that the lower end of the clutch plate may selectively drop into the recess LR1. Clutch plate 241 provides a positive dogtype action in a well-known and conventional manner in conjunction with the recess LR1, in order to lock wheel assembly WA in the position as shown in FIG. 5, in which teeth T1, T2 exert a cutting action in the groove G of ore surface O. Movement of frame F and wheel assembly WA is to the left (or downhill) as shown in FIG. 5. A small wheel 242 is rotatably supported on the back side of clutch plate 241 to act as a cam follower.

When frame F moves in the opposite direction (uphill), as shown in FIG. 11, cam follower 242 rolls along the bottom of groove LR1 and then reaches the cam shoulder CS1, and in doing so lifts the clutch plate 241 completely out of engagement with the recess LR1. An actuator shaft 243 is also pivotally coupled to the clutch or locking plate 241 on its upper side. The shaft 243 may be utilized for receiving control signals from the clutch plate 241, or alternatively may be used to exert a positive control over the position occupied by the clutch plate.

While the hydraulic drive mechanism associated with the cylinders RD is not shown in detail, it may be entirely conventional in its construction and operation. When the carriage or frame F approaches the top of its uphill stroke the hydraulic drive is reversed, the reversal preferably being accomplished by means of a conventional four-way valve mechanism in association with appropriate limit switches and the like, so that the reversal of drive energy does not occur too abruptly but does provide appropriate shock cushioning for the frame F which requires a finite amount of time to slow down, stop, and then reverse its direction of movement. A reversal of the hydraulic drive is accomplished in the same fashion as the frame F approaches the limit of its downhill movement. Both of these reversals of direction may, if desired, be triggered by appropriate limit switches mounted upon the frame F and the housing HO, so that the reversals of movement will occur at predetermined locations of the frame F relative to the housing HO. The use of such a limit switch arrangement (not shown in the drawings) is the presently preferred method of control insofar as the limit downward movement of frame F is concerned. At the limit of upward movement, however, it is presently preferred to control the reversal of the hydraulic drive in response to the rotational position of the wheel assemblies.

To achieve that control, a solenoid (not shown) is utilized in conjunction with the shaft 243. When wheel assembly WA rotates far enough so that the cam follower wheel 242 drops into the locking recess LR1, a longitudinal movement of shaft 243 results, and this movement is detected by the solenoid and is utilized to initiate the reversal of the hydraulic drive system. A short time later the locking end of clutch plate 241 itself drops into the recess LR1, but this does not achieve a locking action because this mechanism is not intended to lock the wheel against rotation in that (the uphill) direction.

The uphill lock is located on the opposite side of wheel assembly WA, and includes a positive clutch plate 231 rotatably supported on shaft 230 from the frame F, and which operates in conjunction with locking recess LR2. Recess LR2 is formed in the wheel in conjunction with cam shoulder CS2. Clutch or locking plate 231 is provided with a cam follower wheel 232 on its inner and under side, and its outer and upper side is pivotally coupled to a shaft 233. It will readily be seen that, except for being arranged to operate for opposite directions of wheel rotation, and being also in somewhat different circumferential positions relative to the wheel, the uphill lock mechanism and the downhill lock mechanism are essentially identical to each other.

It is significant, however, that the two locks do not operate at precisely the same rotational position of the wheel. More specifically, when frame F is driven up the working slope 210 it causes locking plate 241 to rise up out of the recess LR1 as previously described, until exactly one complete revolution of the wheel has been achieved, at which time the locking plate 241 may again drop into the recess LR1. But this does not achieve a locking action and the wheel must rotate some distance further before the uphill lock becomes operative. Clutch plate 231 then drops into and becomes fully engaged with the locking recess LR2. See FIG. 14. This additional distance travelled by the wheel may amount to several inches of movement or several degrees of rotation, and may typically amount to about ten degrees or more of rotation of the wheel.

The uphill locking mechanism is used primarily to limit the over-travel of the wheel assemblies when they have completed one entire revolution during their rolling movement up the working slope 10. It is not only preferred, but appears necessary, that there be some over-travel of the wheels beyond one complete revolution. There are several different factors related to the wheel over-travel, including the following as presently known:

a. There may be some slippage of wheel movements, particularly since one or more wheels may at times be out of engagement with the ore surface. The synchronizing mechanism for the wheels (keyed shafts and interconnecting chain drive system) contains a certain amount of lag, and hence a margin of safety must be allowed for achieving the locking action of the wheel before it starts its downward movement or forward cutting stroke on the working surface of the ore.

Some amount of extra rotation of the wheel is desirable in order to make sure that the point at which the downhill lock can operate has been reached. In order to make sure that point has been reached, the wheel is rotated somewhat beyond it.

b. Some overlap between adjacent sets of wheel assemblies, such as WA1 and WA2, is desirable and perhaps essential. That is, the cutting action of tooth T1 is not immediately effective simply because it engages the groove and its associated wheel assembly has been locked against rotation. Tooth T1 must move forward some measurable distance before its cutting action becomes effective. Hence it is desirable to have some overlap between the latter portion of the cutting movement of teeth T1 of wheel assemblies WA2, and the initial portion of the cutting path of teeth T1, T2 of wheel assemblies WA1.

c. It is necessary for the machine as a whole to continuously advance in the direction in which the tunnel is being cut. Therefore, the distance that frame F travels uphill must, on the average, be somewhat greater than the distance that it travels downhill.

While no precise analysis of these factors is provided here, they do collectively lead to the conclusion that the machine must provide for a finite amount of over-travel of the wheels, after they have rotated by one complete rotation while traveling up the working surface 210. Hence the circumferential displacement of the operative position of the uphill lock 231, LR2 relative to the downhill lock 241, LR1.

It is desirable to control the action of the uphill lock with appropriate powered controls, operating through the shaft 233. Thus the clutch plate 231 is urged against cam shoulder CS2 whenever the associated wheel assembly WA approaches the locking position; and when frame F has reversed its direction of travel and is again moving down the slope, clutch plate 231 is positively lifted out of engagement with the cam shoulder CS2 and so remains while the carriage F completes its downward stroke and again enters its upward stroke. These actions of the clutch plate 231 may be controlled by appropriate electronic or hydraulic mechanism, not shown in the present drawings.

The locking action of the downhill lock 241, LR1 may, in theory, be controlled entirely by gravity. However, the possibility of chips of ore entering the mechanism, or other factors that might interfere with its operation, make it desirable for this locking mechanism also to have a positive control and a positive drive. Again, the control may be accomplished by appropriate electronic means, not shown in the present drawings.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A method of mining ore from an ore surface by means of reciprocating movements thereon, comprising the steps of:

selecting a cutting tooth;

selecting a wheel having a circumferential edge portion of wedge-shaped radial cross-sectional configuration;

supporting the tooth and the wheel in juxtaposition to each other and to the ore surface;

reciprocatingly moving the tooth and the wheel, in synchronism, across the ore surface;

in one direction of movement, shifting substantially all of the weight of both wheel and tooth to the tooth so that the tooth cuts a groove in the ore surface; and in the other direction of movement, shifting substantially all of the weight of both wheel and tooth to the wheel, and supporting the wheel for rotation relative to the ore surface so that the wheel edge rolls within the groove;

whereby when the groove becomes sufficiently deep, the wheel edge applies an outward and downward crumbling force to the upper edges of the groove walls.

2. A method of mining ore from an ore surface by means of reciprocating movement of a mining tool structure thereon, comprising the steps of:

selecting a cutting tooth adapted to cut a groove of predetermined width;

selecting a wheel having a circumferential edge of generally wedge-shaped radial cross-section, and whose base is thicker than said predetermined groove width;

attaching both the tooth and the wheel to the tool structure in a common plane of longitudinal movement;

shifting substantially all of the weight of the tool structure to the tooth, and moving the tool structure along the ore surface so that the tooth cuts a groove therein; and then shifting substantially all the weight of the tool structure to the wheel, and moving the tool structure across the ore surface in the opposite direction so that the wheel rolls within the groove;

whereby when the groove is sufficiently deep the wheel edge applies outward and downward crumbling forces to the upper edges of the groove walls.

3. A method of mining ore from an ore surface comprising the steps of:

selecting a cutting tooth adapted to cut a groove of predetermined width;

selecting a wheel having a circumferential edge portion of generally wedge-shaped radial cross-section and having a base which is thicker than said predetermined groove width;

supporting the wheel and the tooth from a common structure;

placing the tooth in engagement with the ore surface, while keeping the wheel edge spaced away from the ore surface, and moving said common structure parallel to the ore surface so that the tooth cuts a groove therein;

placing the wheel edge within the groove, while holding the cutting tooth out of contact with the ore surface, supporting the wheel for rotation about its axis, and moving said common structure in the opposite direction parallel to the ore surface so that the wheel rolls within the groove, thereby applying an outward and downward crumbling force to the upper edges of the groove walls; and continuing to reciprocatingly move said common structure along the ore surface and apply the tooth thereto in one direction of movement and the wheel thereto in the other direction of movement.

4. The method of dislodging ore from an ore surface comprising the steps of:

selecting a wheel whose circumferential edge portion is radially tapered to a relatively thin circumferential edge;

selecting a cutter having a width which is substantially greater than the thickness of said wheel edge;

attaching the cutter to the wheel at one point on its circumference so that the cutter extends radially beyond the circumferential edge of the wheel;

aligning the wheel with cutter thereon in a plane substantially perpendicular to the ore surface, and placing the cutter in engagement with said surface;

holding the wheel against rotation while concurrently driving it in a direction parallel to the ore surface for at least a distance which is about equal to the wheel circumference, so as to cut a groove in the ore surface; and then supporting the wheel for rotation about its axis and propelling it in the opposite direction so that the tapered edge of the wheel engages both lateral side walls of the groove and the cutter rotates through an angle of at least 360° to its starting position.

5. The method of dislodging ore from an ore surface comprising the steps of:

forming an elongated, substantially straight groove in the ore surface;

selecting a wheel having a wedge-shaped circumferential edge and having a rigidly attached thereto at one point on its circumference;

supporting the wheel for rotation about its axis, inserting the circumferential edge of the wheel within the groove, and then forcing the wheel towards the groove and concurrently rollingly moving the wheel within the groove so that the wedge-shaped wheel edge applies a rupturing force to both walls of the groove, until the cutter engages the groove;

holding the wheel against rotation and retracting the wheel and cutter in the opposite direction by a distance at least equal to the wheel circumference, so that the cutter is dragged along the groove bottom; and then again rolling the wheel along the groove in the same direction as previously.

6. A reciprocating method of dislodging ore from an ore surface comprising the steps of:

forming an elongated, substantially straight groove in the ore surface;

selecting a pair of wheels which are of substantially the same diameter, and each having a wedge-shaped circumferential edge;

positioning the wheels in a common plane with their axes of rotation being separated by a distance that is about equal to the wheel circumference;

supporting the wheels from a common frame for rotation about their respective axes;

inserting both wheel edges within the groove, and then moving the common frame along the groove so that the wheel edges engage both of the groove walls and apply laterally outward bursting forces thereto; and when the wheels have traversed a distance that is somewhat greater than the wheel circumference, disengaging the wheels from the groove and then returning the wheels and frame to the position where the wheels engaged the groove initially.

7. A reciprocating method of dislodging ore from an ore surface comprising the steps of:

forming an elongated, substantially straight groove in the ore surface;

selecting a pair of wheels which are of substantially the same diameter, and each having a wedge-shaped circumferential edge;

positioning the wheels in a common plane with their axes of rotation being separated by a fixed distance;

supporting the wheels from a common frame for rotation about their respective axes;

inserting both wheel edges within the groove, and then moving the common frame along the groove so that the wheel edges engage both of the groove walls and apply laterally outwardly bursting forces thereto;

when the wheels have traversed a distance that is somewhat greater than said fixed distance, so that the rearward wheel has rolled over a portion of the groove length that was previously transversed by the forward wheel, disengaging the wheels from the groove, and moving the wheels and frame in the opposite direction to the position where the wheels engaged the groove initially; and again inserting both wheel edges within the groove.

8. The method of dislodging ore from an ore surface comprising the steps of:

selecting a wheel having a wedge-shaped circumferential edge;

selecting a cutter;

rigidly attaching the cutter to a point on the circumference of the wheel so as to extend radially beyond the circumferential edge of the wheel;

placing the cutter in engagement with the ore surface while concurrently holding the wheel against rotation and moving the wheel and cutter in a direction parallel to the ore surface so as to cut a groove therein;

and then supporting the wheel for rotation and retracting the wheel along its previous path so that the circumferential edge of the wheel rolls within the groove while the cutter rotates through an angle of 360 degrees so as to return to a position of engagement with the ore surface.

9. A reciprocating method of dislodging ore from an ore surface comprising the steps of:

selecting a wheel having a wedge-shaped circumferential edge;

rigidly attaching a cutter to a point on the circumference of the wheel;

while holding the wheel against rotation, placing the cutter in engagement with the ore surface and moving the wheel and cutter in a direction parallel to the ore surface so as to cut a groove therein;

supporting the wheel for rotation about its axis and retracting it along its previous path so that the circumferential edge of the wheel rolls within the groove until the cutter again returns to a position of engagement with the ore surface; and again holding the wheel against rotation, and moving the wheel and cutter parallel to the ore surface by a sufficient distance so that the cutter not only retraces the previously cut groove but also forms a forward extension thereof.

10. The method of dislodging ore from a relatively flat ore surface in a manner calculated to provide an even rate of wear of the cutting elements of a mining machine, comprising the steps of:

selecting a plurality of mining tools each capable of alternately presenting a cutting tooth and a wedge-shaped wheel to the ore surface to be mined;

placing all of the tools in laterally spaced relationship upon the ore surface;

controlling all of the tools so as to present their respective cutting teeth to the ore surface, and then moving all of the tools in unison along the ore surface so as to cut a plurality of parallel grooves therein; and thereafter controlling the tools so as to withdraw the cutting teeth from the ore surface, and to substitute the wheels in place thereof, and then drawing all of the tools concurrently along the ore surface in the opposite direction so that each wheel rolls within the groove previously cut by its associated tooth.

11. A reciprocating method of dislodging ore from a generally flat ore surface, comprising the steps of:

placing a plurality of cutting teeth in laterally spaced positions upon the ore surface;

advancing all of the cutting teeth concurrently along the ore surface in generally straight-line paths, while at the same time pushing them against the ore surface so as to form a corresponding plurality of grooves therein;

replacing the cutting teeth in alternate grooves with respectively corresponding wedge-shaped wheels; and then rollingly withdrawing all of the wheels concurrently along the ore surface so that they roll in the opposite direction within the previously formed alternate grooves, and at the same time pushing them towards the ore surface so as to rupture the ore material between the grooves.

12. A reciprocating mining tool adapted for alternately cutting a groove of predetermined width in the surface of an ore bed, and for then breaking down the walls of the groove to dislodge ore from the bed, comprising:

a wheel whose circumferential edge portion is of wedge-shaped cross-sectional configuration in the radial direction, said circumferential edge portion at its inward extremity having a thickness significantly greater than the groove width and at its outward extremity having a thickness significantly less than the groove width; and a cutting tooth attached to said wheel at a point on the circumference thereof, said tooth having its width extending transverse to the plane of said wheel, said tooth's being equal to the predetermined groove width, said tooth extending radially outward with respect to said wheel beyond said outward extremity thereof;

said tool being held against rotation on one stroke when said tooth is cutting the groove, and being allowed to rotate about the wheel axis on its other stroke when said wheel edge rolls within the groove.

13. The mining tool of claim 12 which includes an additional cutting tooth attached to the circumference of said wheel behind said first-named tooth.

14. A reciprocating mining tool adapted for alternately cutting a groove in the surface of an ore bed and then breaking down the walls of the groove to dislodge ore from the bed, comprising:

a wheel whose circumferential edge portion throughout at least three-fourths of its circumference is of wedge-shaped cross-sectional configuration in the radial direction;

a cutting tooth located within the remaining circumferential portion of said wheel, said tooth being attached to said wheel with its width extending transversely of the plane of said wheel;

axle means supporting said wheel for rotation about its radius center;

first locking means associated with said wheel for locking said wheel against rotation in one direction; and second locking means associated with said wheel for locking said wheel against rotation in the opposite direction.

15. A mining tool as claimed in claim 14 which also includes an additional cutting tooth located within said remaining circumferential portion of said wheel, behind said first-named tooth, and attached to said wheel.

16. A reciprocating mining tool adapted for alternately cutting a groove of predetermined width in the surface on an ore bed, and for then breaking down the walls of the groove to dislodge ore from the bed, comprising:

a circular wheel;

means mounting said wheel for rotation about its radial center;

a cutting tooth attached to said wheel at a point on the circumference thereof, said tooth having its width extending transverse to the plane of said wheel and said width being equal to the predetermined groove width;

means for holding said tool against rotation on one stroke thereof when said tooth is cutting the groove, said tool on its other stroke being allowed to rotate about said mounting means so that the wheel edge rolls within the groove; and the circumferential edge portion of said wheel having a wedge-shaped cross-sectional configuration in the radial direction and its inward extremity having a thickness significantly greater than the groove width while its outward extremity has a thickness significantly less than the groove width, so that the wheel edge when rolling within the groove applies an outward and downward crumbling force to the upper edges of the groove walls;

said tooth extending radially further outward than the wheel edge so as to facilitate deepening the groove during said one stroke of said tool.

17. A reciprocating mining tool adapted for alternately cutting a groove of predetermined width in the surface of an ore bed, for then breaking down the walls of the groove to dislodge ore from the bed, and for concurrently dressing the gauge of a side wall that extends perpendicular to said ore bed surface, comprising:

a wheel which is flat on one side and whose circumferential edge portion is of wedge-shaped cross-sectional configuration in the radial direction, said circumferential edge portion at its inward extremity having a thickness significantly greater than the groove width and at its outward extremity having a thickness significantly less than the groove width;

a cutting tooth attached to said wheel at a point on the circumference thereof, said tooth having one side thereof aligned with said flat wheel side, said tooth having its width extending transverse to the plane of said wheel and said width being equal to the predetermined groove width, said tooth extending radially outward with respect to said wheel beyond said outward extremity thereof;

said tool being held against rotation on one stroke when said tooth is cutting the groove, and being allowed to rotate about the wheel axis on its other stroke when said wheel edge rolls within the groove; and a plurality of gauge-cutting bits mounted in said flat side of said wheel.

18. A method of dislodging ore material from a drift of a mine which has a generally rectangular cross-sectional configuration, comprising the steps of:

selecting a plurality of wheels each having a wedge-shaped circumferential edge;

placing the wheels in laterally separated, parallel, substantially vertical planes;

supporting the wheels for rotation in concert about a common axis of rotation;

selecting a plurality of cutting teeth, one for each wheel, and rigidly attaching each cutting tooth to a point on the circumference of the associated wheel so that the plurality of cutting teeth occupy a common circumferential position on said wheels;

applying the assembly of wheels to the end face of the drift that is to be mined;

reciprocatingly moving the assembly of wheels in a vertical direction across the end face of the drift;

each time that the cutting teeth engage the ore surface during a forward stroke of the reciprocating movement, holding all of the wheels against rotation until a selected distance has been traveled so that the teeth cut grooves in the ore surface; and releasing the wheels for rotation during each return stroke of the reciprocating movement so that they are effective for breaking the core material between the grooves.

19. The method of forming in an underground mine a drift having a substantially rectangular cross-section, comprising the steps of:

cutting in an exposed surface of the ore material a plurality of parallel, generally vertically extending grooves;

selecting a number of wheels each having a wedge-shaped circumferential edge;

placing the edges of respective wheels within alternate ones of the grooves;

rollingly moving the wheels, in concert, in a vertical direction in the grooves so as to break the core material between the grooves;

applying cutting teeth to the grooves in the opposite direction of movement so as to deepen the grooves; and then reapplying the wheels to the grooves and rolling them therein in the same direction as before.

20. The mining tool claimed in claim 12 which further includes radially arranged ribs circumferentially arranged about both surfaces of said wedge-shaped wheel edge portion, and firmly secured on respective ones of said surfaces.

21. In a mining machine, a mining tool adapted to travel within a substantially straight groove that has been formed in a substantially flat ore surface, and to apply outward and downward crumbling forces to the upper edges of the groove walls, comprising:

a wheel having a radially wedge-shaped circumferential edge portion the radial extremity of said wheel being sufficiently thin to be inserted within the groove;

a plurality of ribs carried by and upon said wedge-shaped wheel edge portion, said ribs being radially arranged and circumferentially spaced upon each of the circumferential surfaces of said wheel portion; and means mounting said wheel for rotation about its axis, said mounting means being adapted to be propelled along and parallel to the groove so that said wheel rotates and said radial extremity of said wheel rolls within the groove;

said wheel ribs then engaging longitudinally separated sections of the groove walls so that the crushing force applied by said wheel to the groove walls is concentrated within said longitudinal sections.

22. A method of gauging the side walls of a tunnel as the tunnel is advanced, comprising the steps of:

placing in the tunnel on the lateral sides thereof a pair of gauge wheels for cutting and gauging the side walls of the tunnel, each of said gauge wheels having a substantially flat outer surface;

placing a plurality of cutters on said flat outer surface of each of said gauge wheels in circumferentially spaced positions thereon;

reciprocably driving said wheels longitudinally within the tunnel so that they rotate first in one direction and then in the other; and continuously advancing the wheels as they reciprocate, and on each reciprocation readjusting the starting point of their rotation, so that said cutters cut the longitudinal side walls of the tunnel to a flat configuration and on successive reciprocations of the wheels said cutters form successively advancing sets of crisscrossing cutting paths on said side walls.

23. A method of mining comprising the steps of:

cutting through the material to be mined a substantially horizontal tunnel having a vertical cross-sectional configuration which is substantially rectangular, with substantially flat ceiling, floor and side walls;

forming in the end face of the tunnel a generally flat, sloping working surface which extends upward from the tunnel floor at an angle of the order of 40 degrees;

placing upon said working surface a mining machine having a width which is substantially fully equal to the tunnel width, and having a plurality of laterally spaced mining tools which engage said working surface so as to substantially support the weight of said machine from and upon said working surface;

periodically driving said machine upwardly, from the lower end of said working surface to the upper end thereof;

each time that said machine is driven to the upper end of said working surface, causing it then to move back down said working surface, so that during the downward movement of said machine a substantial mining action upon said working surface is achieved by virtue of the weight of said machine pressing said tools against said surface; and guiding said mining machine through a curved pathway at both the lower end of its stroke and the upper end of its stroke, so that said tools not only dislodge ore material from said working surface but also cut longitudinal extensions of said ceiling and floor.

24. A mining machine adapted for reciprocating operation upon a sloped working surface at the end face of a substantially horizontal tunnel, said machine comprising:

a generally rectangular frame adapted to be disposed in substantially parallel relationship to the working surface;

at least two transversely extending rows of wheels disposed beneath said frame, all of the wheels in each row being mounted for rotation relative to said frame about a common axis, and each wheel in each row being aligned in a common plane with a corresponding wheel of each other row to provide aligned groups of wheels which move in a common groove as said frame reciprocates;

the outer wheels in each row being gauge wheels having flat outer surfaces upon which a plurality of cutters are mounted for cutting and gauging the side walls of the tunnel;

the intermediate wheels in each row being of wedge-shaped cross-sectional configuration in the radial direction;

each of said wheels having a cutter secured to one point on the circumference thereof, the cutter extending beyond the radial extremity of the wheel and have a width measured in a direction transverse to the plane of the wheel which is greater than the wheel thickness at its radial extremity but less than the wheel thickness at the inner end of said wedge-shaped configuration;

a plurality of rows of separate cutters, one row being associated with each of said rows of wheels, each said separate cutter being laterally spaced between two wheels of the associated row of wheels; and means for controlling the operation of said wheels and cutters such that when said machine frame moves up the sloped working surface all of said wheels are located against rotation with the cutters thereof being in engagement with the working surface, and all of said separate cutters are also locked in engagement with the working surface, whereas when said machine frame moves downward on the working surface all of said separate cutters are held out of engagement with the working surface while all of said wheels are permitted to rotate relative to said frame;

whereby during the upward movement of said frame a plurality of longitudinally extending, parallel grooves are formed in the working surface, and on the downward movement of said machine frame said wheels apply lateral crumbling and bursting forces to the walls of alternate ones of said grooves.

* * * * *

UNITED STATES PATENT OFFICE

CERTIFICATE OF CORRECTION

Patent No. 4,062,594 Dated December 13, 1977

Inventor(s) John C. Haspert

It is certified that error appears in the above-identified patent and that said Letters Patent are hereby corrected as shown below:

Column 26, line 10, "up" should read -- down --.

Column 26, line 11, "located" should read -- locked --.

Column 26, lines 15 and 16, "downward" should read -- upward --.

Column 26, line 20, "upward" should read -- downward --.

Column 26, line 23, "downward" should read -- upward --.

Signed and Sealed this

Eighteenth Day of April 1978

[SEAL]

Attest:

RUTH C. MASON
Attesting Officer

LUTRELLE F. PARKER
Acting Commissioner of Patents and Trademarks